US009297379B2

(12) United States Patent
Patterson et al.

(10) Patent No.: US 9,297,379 B2
(45) **Date of Patent: *Mar. 29, 2016**

(54) OVAL CHAMBER VANE PUMP

(71) Applicant: WindTrans System Ltd, Seaforth (CA)

(72) Inventors: Dan Patterson, Seaforth (CA); Andrew Masse, Seaforth (CA)

(73) Assignee: WindTrans Systems Ltd, Seaforth (CA)

( * ) Notice: Subject to any disclaimer, the term of this patent is extended or adjusted under 35 U.S.C. 154(b) by 302 days.

This patent is subject to a terminal disclaimer.

(21) Appl. No.: 13/710,331

(22) Filed: Dec. 10, 2012

(65) Prior Publication Data

US 2013/0202472 A1 Aug. 8, 2013

Related U.S. Application Data

(60) Provisional application No. 61/695,635, filed on Aug. 31, 2012, provisional application No. 61/729,373, filed on Nov. 22, 2012.

(30) Foreign Application Priority Data

Jan. 16, 2012 (CA) ..... 2764669
Nov. 22, 2012 (CA) ..... 2796484

(51) Int. Cl.
*F01C 19/00* (2006.01)
*F03C 2/02* (2006.01)
(Continued)

(52) U.S. Cl.
CPC ..... *F04C 2/344* (2013.01); *F01C 21/0836* (2013.01); *F01C 21/106* (2013.01); *F04C 2/3441* (2013.01); *F04C 15/0061* (2013.01); *F04C 2250/30* (2013.01)

(58) Field of Classification Search
CPC .. F01C 21/0836; F04C 2/344; F04C 15/0061; F04C 2/3442; F04C 2/3445
USPC ..... 418/143, 253, 257, 259, 264–268, 227, 418/260
See application file for complete search history.

(56) References Cited

U.S. PATENT DOCUMENTS 1,237,273 A 8/1917 Baade
2,312,961 A * 3/1943 Cowherd ..... 418/269
(Continued)

FOREIGN PATENT DOCUMENTS

CA 2421188 A1 3/2003
JP 1100397 7/1989
WO WO-/2012/079144 2/2012

OTHER PUBLICATIONS

International Search Report for Application No. PCT/CA2012/001135 dated Mar. 20, 2013.
(Continued)

*Primary Examiner* — Jorge Pereiro
*Assistant Examiner* — Deming Wan
(74) *Attorney, Agent, or Firm* — Honigman Miller Schwartz and Cohn LLP

(57) ABSTRACT

A rotary device includes a housing having a tubular surface. The surface has an throughpassing axis and first and second ports. A rotor body rotates about the axis and has a plurality of slots extending generally radially from the axis. A vane is mounted in each slot for reciprocation such that the surface can be swept by the vanes as the body rotates. A seal permits fluid to flow into and out of the device substantially only via the first and second ports such that the vanes create chambers which decrease in volume when in communication with the first port and increase in volume when in communication with the second port. The tubular surface is oval in cross-section.

10 Claims, 30 Drawing Sheets

(51) Int. Cl.

| | |
|---|---|
| ***F04C 2/02*** | (2006.01) |
| ***F04C 15/00*** | (2006.01) |
| ***F04C 27/00*** | (2006.01) |
| ***F04C 2/344*** | (2006.01) |
| ***F01C 21/08*** | (2006.01) |
| ***F01C 21/10*** | (2006.01) |

(56) References Cited

U.S. PATENT DOCUMENTS

| | | | | |
|---|---|---|---|---|
| 4,073,608 | A * | 2/1978 | Christy | 418/241 |
| 5,242,285 | A * | 9/1993 | Westermann, Jr. | 418/111 |
| 5,634,783 | A * | 6/1997 | Beal | 418/264 |
| 5,899,677 | A | 5/1999 | Ono et al. | |
| 6,659,067 | B1 | 12/2003 | Al-Hawaj | |
| 7,118,361 | B2 * | 10/2006 | Patterson | 418/268 |
| 7,229,262 | B2 * | 6/2007 | Patterson | 418/133 |
| 7,255,546 | B1 * | 8/2007 | Del Rio | 418/259 |
| 2008/0240935 | A1 | 10/2008 | Dong | |
| 2011/0311387 | A1 * | 12/2011 | Schultz | 418/230 |
| 2013/0202468 | A1 * | 8/2013 | Patterson | F01C 21/0836 418/1 |

OTHER PUBLICATIONS

International Search Report for PCT/CA2014/000192 dated Jul. 7, 2014.

* cited by examiner

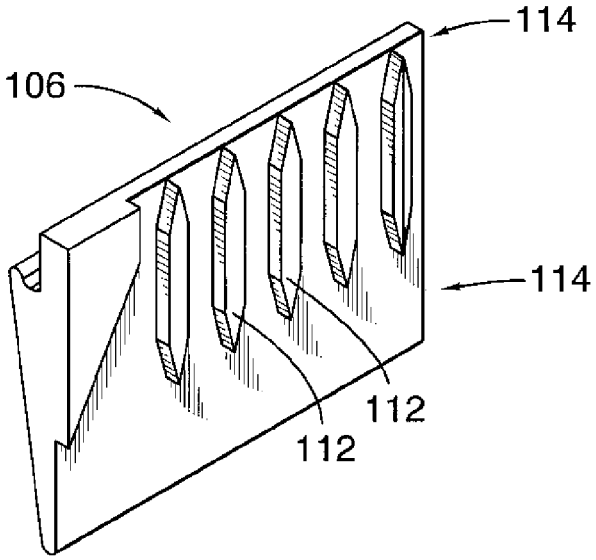
FIG.23A
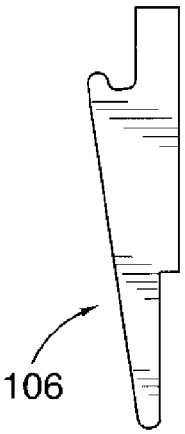
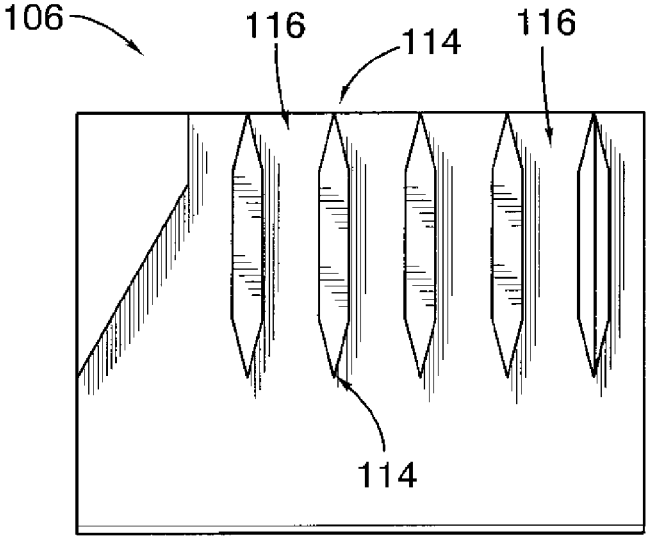
FIG.23B
FIG.23C

OVAL CHAMBER VANE PUMP

FIELD OF THE INVENTION

The invention relates to the field of rotary devices, such as pumps.

BACKGROUND OF THE INVENTION

A vane pump consists of vanes mounted to a rotor that rotates inside a cavity. These vanes can be of variable length and/or tensioned to maintain contact with the cavity wall as the pump rotates.

SUMMARY OF THE INVENTION

A rotary device for use with a fluid forms one aspect of the invention. The device comprises: a housing having a tubular surface, the tubular surface having a rotation axis passing therethrough in spaced relation and having first and second ports defined therein; a rotor mounted for rotation about the axis, the rotor including a body mounted interiorly of the tubular surface and having a plurality of slots, each slot extending at least generally radially from the axis; for each slot, a vane, the vane being mounted in the slot for reciprocation; an arrangement for causing the vanes to retract and extend as the rotor body rotates, to sweep the tubular surface at least in part; and a sealing structure providing a seal to permit said fluid to flow into and out of the rotary device substantially only via the first and second ports and adapted such that the vanes create chambers which decrease in volume when in communication with the first port and increase in volume when in communication with the second port. The device is characterized in that the arrangement is such that, in use, each vane extends and retracts only when the fluid pressure on the leading and trailing surface of the vane is substantially equal.

According to another aspect of the invention, the tubular surface can be oval in cross-section.

According to another aspect of the invention, the arrangement can defined by: an oval track defined in the housing; and for each vane, a track follower which traverses the track and is rigidly connected to said each vane.

According to another aspect of the invention: the oval track can be defined by a pair of oval raceways defined on opposite sides of the housing body; and the track follower for each vane can be defined by a roller assembly for each raceway, each roller assembly including an arm extending from said each vane and a roller rotatably mounted to the arm to traverse said raceway.

According to another aspect of the invention, the rotor body can be cylindrical.

According to another aspect of the invention, each vane can extend and retract along a respective translation axis defined by the slot for which said each vane is provided, said translation axis being offset from the rotation axis such that, in use, when the fluid pressure on the leading and trailing surface of the vane is otherwise than substantially equal, said each vane is orientated substantially perpendicular to the direction of fluid flow.

According to another aspect of the invention, the rotor can further comprise a pair of discs mounted on opposite sides of the rotor body and having grooves defined therewithin aligned with the slots of the rotor body to support the vanes when extended.

According to another aspect of the invention, the device can further comprise a main shaft rigidly mounted to the rotor body and defining the rotation axis.

According to another aspect of the invention, the device can further comprise: a secondary shaft rotatably coupled to the housing; and a gear arrangement operatively coupling the secondary shaft to the rotor.

According to another aspect of the invention, the gear arrangement can comprise: a pair of first gears carried by the secondary shaft; and for each first gear, a second gear carried by the rotor and in mesh with said each first gear.

According to another aspect of the invention, in use, as each vane passes a pumping area, a gap can open between the tubular surface and the vane, and as each vane approaches the pumping area, the gap can close.

According to another aspect of the invention: the oval track can be defined by a pair of oval raceways defined on opposite sides of the housing body; and the track follower for each vane can be defined by a roller assembly for each raceway, each roller assembly including an arm extending from said each vane and terminating in a pintle and a bearing receiving the pintle for rotation and itself mounted for sliding motion along said raceway.

According to another aspect of the invention, the bearings can function in the manner of a spring to allow for limited radial motion of the vane.

According to another aspect of the invention, the bearings can, in the rotary device, be pre-stressed so as to counter frictional forces that would otherwise tend to rotate the bearings in the raceways and result in wear and binding.

According to another aspect of the invention, the raceways can be adapted such that, but for the spring action of the bearings, the wipers would be in interference contact with the tubular surface.

According to another aspect of the invention, each slot can have a surface against which the vane for said slot slides, the surface being defined by a plurality of raised ridges, so as to define channels in which fluid can travel and avoid hydraulic lock on vane extension and retraction which could otherwise occur.

According to another aspect of the invention, vent plates can be provided for and define part of each slot, each vent plate defining the surface having raised ridges against which the vane slides and terminating at its radial limit in an arcuate extension of the rotor body.

Advantages, features and characteristics of the present invention, as well as methods of operation and functions of the related elements of the structure, and the combination of parts and economies of manufacture, will become more apparent upon consideration of the following detailed description and the appended claims with reference to the accompanying drawings, the latter being briefly described hereinafter.

BRIEF DESCRIPTION OF THE DRAWINGS

FIG. 23A is a perspective view of another portion of the structure of FIG. 20;

FIG. 23B is an end view of the structure of FIG. 23A;

FIG. 23C is a front view of the structure of FIG. 23A;

DESCRIPTION

Figure 1:
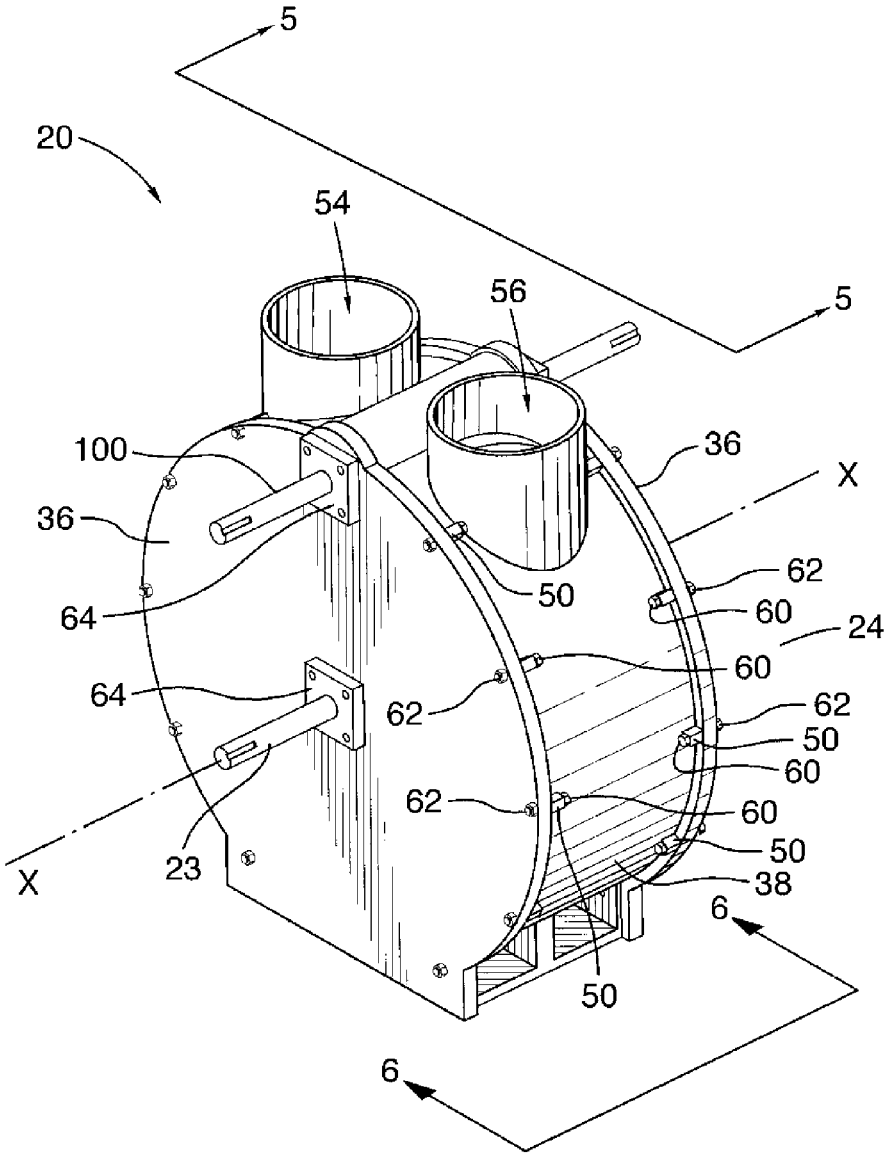
FIG. 1 is a perspective view of a pump according to an exemplary embodiment of the invention.

An exemplary embodiment of the invention is shown in FIGS. 1-18 and is embodied as a pump 20. The pump will be seen in FIG. 3 to comprise a housing 22, a primary shaft 23, a rotor body 24, a plurality of vanes $\mathbf{26}^1$, $\mathbf{26}^2$, $\mathbf{26}^3$, etc., a pair of discs 28, an arrangement 30, a sealing structure 32 and a coupler 34.

The housing 22 includes a pair of end plates 36 and a housing body 38.

Figure 2:
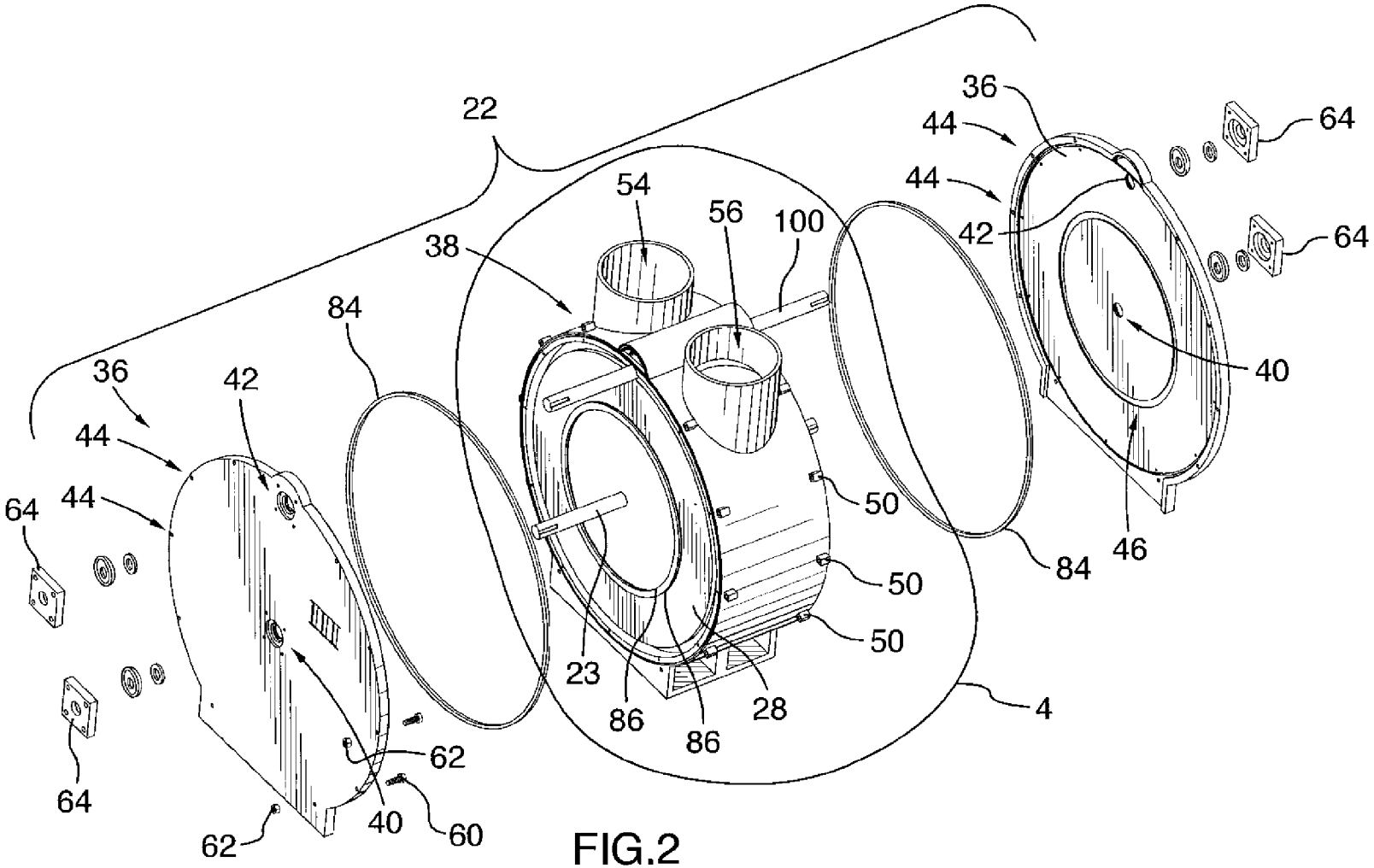
FIG. 2 is a partially exploded view of the structure of FIG. 1.

As best seen in FIG. 2, each end plate 36 has a central aperture 40, a peripheral aperture 42, a plurality of through holes 44 and, on the inner face thereof, an annular groove 46.

With reference to FIGS. 1-5B, the housing body 38: is captured between the end plates 36; defines interiorly a tubular surface 48; defines interiorly a throughpassing bore 49; has a plurality of lugs 50 disposed exteriorly thereof; and has defined therewithin, on each side, an annular channel 52. Tubular surface 48 will be seen to: be oval in cross-section; to have first 54 and second 56 ports defined therein; and to have a socket 58 defined therewithin, intermediate the ports 54,56. The lugs 50 are provided one for each of the throughholes 44 of the end plates 36 and are occupied, in use, by nut 60 and bolt 62 assemblies that secure the end plates 36 to the housing body 38. In this description and in the accompanying claims, "oval" shall be understood to have the ordinary meaning attributed thereto, namely, generally in the shape of an egg, and does not imply any specific geometric relationship.

The primary shaft 23, which is keyed at both ends and centrally, passes through the tubular surface 48 in spaced parallel relation and is mounted for rotation to the end plates 36 by bearings 64.

The rotor body 24, which is disposed interiorly of the tubular surface 48 and mounted to the primary shaft 23 for rotation therewith, has a plurality of slots $\mathbf{66}^1$ $\mathbf{66}^2$, $\mathbf{66}^3$, etc., each slot 66 extending generally radially from the rotational axis X-X of the shaft 23.

Figure 10:
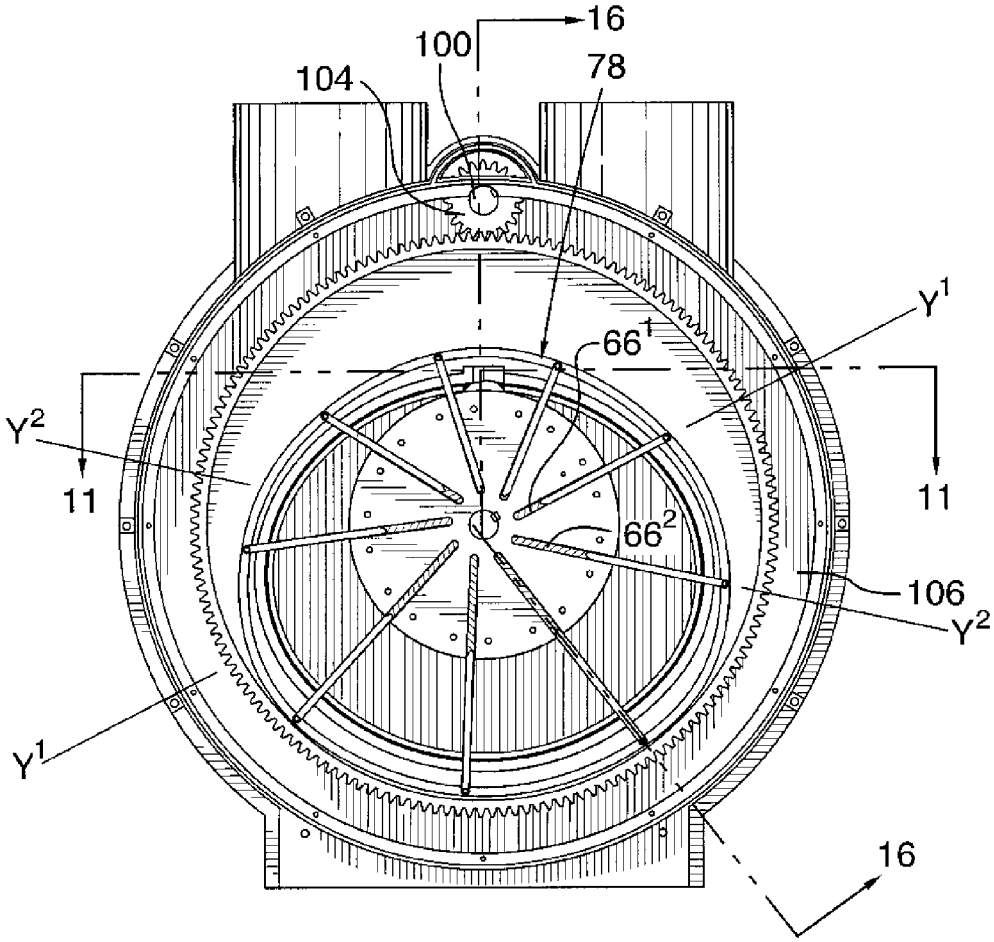
FIG. 10 is a front view of the structure of FIG. 7.
Figure 11:
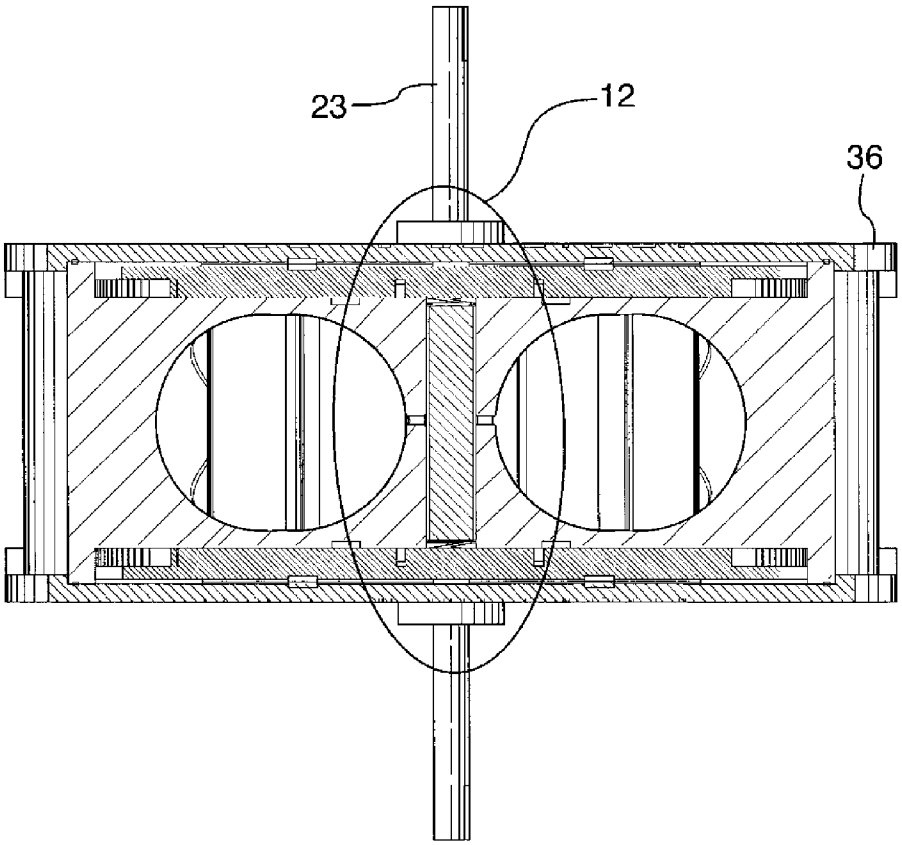
FIG. 11 is a view along 11-11 of FIG. 10.
Figure 12:
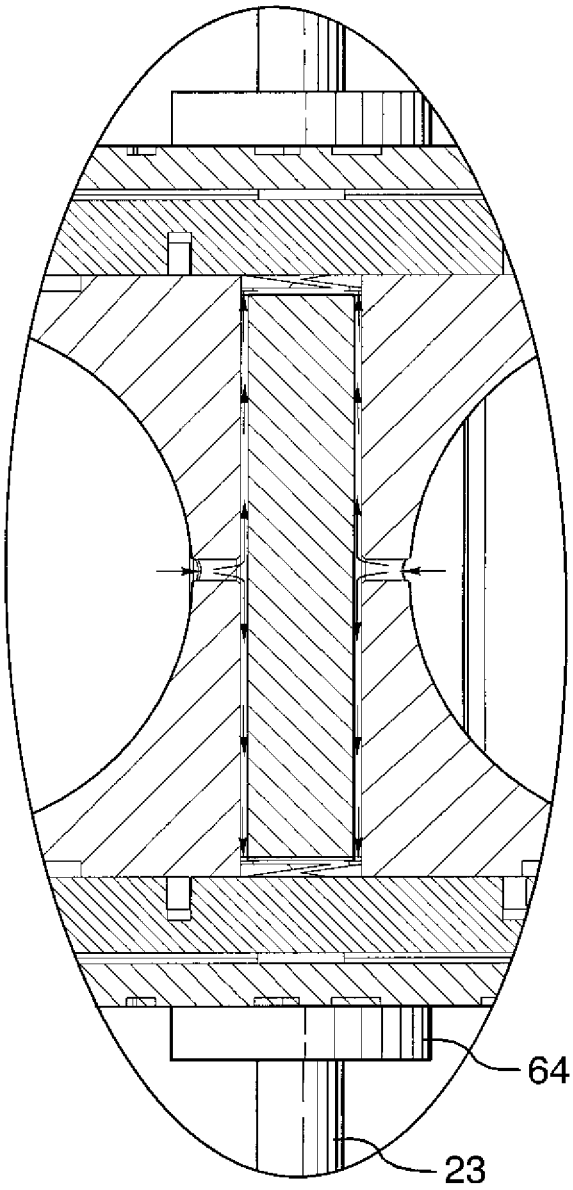
FIG. 12 is an enlarged view of encircled area 12 of FIG. 11.

The vanes 26 are provided one for each slot 66, each vane 66 being mounted in the slot 66 for which it is provided for reciprocation such that the tubular surface 48 can be swept by the vanes 26 as the rotor body 24 rotates. Each vane 26 extends and retracts along a translation axis $Y^1$-$Y^1$, $Y^2$-$Y^2$, etc. defined by the slot 66 for which said each vane 26 is provided, as indicated in FIG. 10

Returning to FIGS. 1 and 3, the discs 28 will be seen to be mounted on opposite sides of the rotor body 24 and have radial grooves 68 defined therewith aligned with the slots 66 of the rotor body 24 to support the vanes 26 when extended. Exteriorly of each disc 28 there is defined an annular groove 46.

The discs 28, in combination with the rotor body 24, define a rotor.

The arrangement 30 is for causing the vanes 26 to retract and extend as the rotor body 24 rotates, to sweep the tubular surface 48, and comprises an oval track 72 and, for each vane 26, a track follower 74 that traverses the track 72 and is rigidly connected to said each vane 26. The oval track 72 is defined by a pair of oval raceways 78 defined on opposite sides of the housing body 24.

Figure 4:
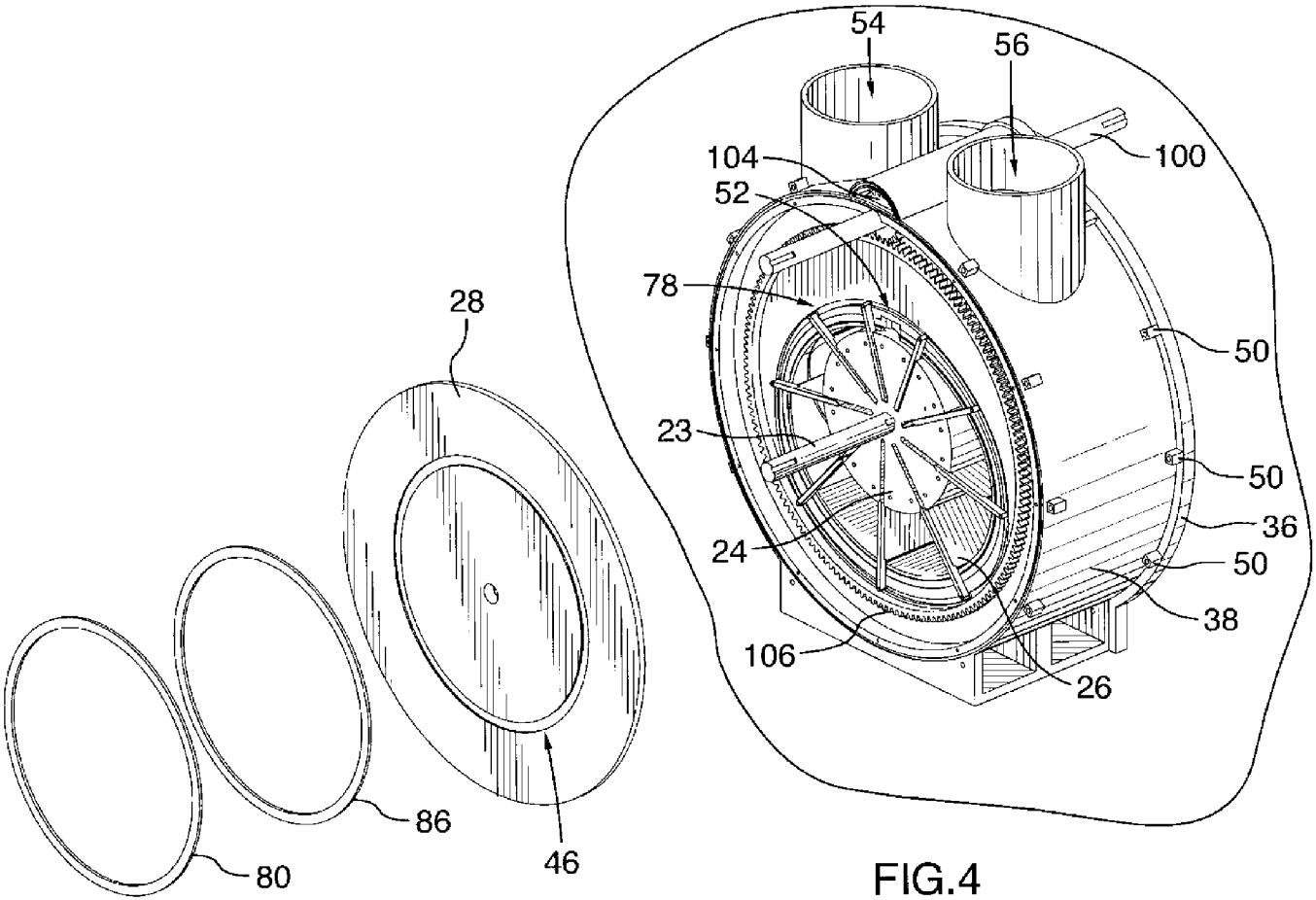
FIG. 4 is a partially exploded view of encircled area 4 of FIG. 2.
Figure 4A:
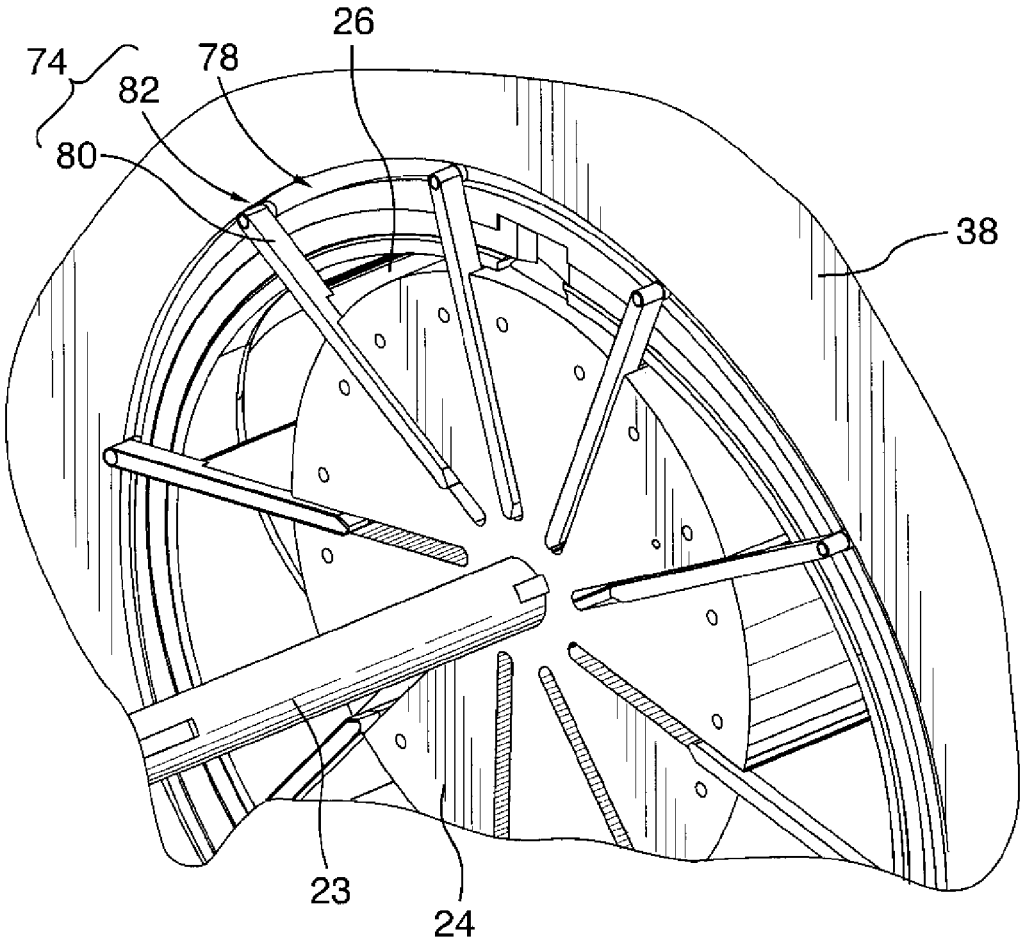
FIG. 4A is an enlarged view of a portion of FIG. 4.

The track follower 74 for each vane is defined by a roller assembly for each raceway 78, each roller assembly including an arm 80 rigidly extending from said each vane and a roller 82 rotatably mounted to the arm 80 to traverse said raceway 78, all as indicated in FIG. 4A The sealing structure 32 is for providing a seal to permit said fluid to flow into and out of the rotary device 20 substantially only via the first 54 and second 56 ports and adapted such that the vanes create chambers which decrease in volume when in communication with the first port 54 and increase in volume when in communication with the second port 56.

Figure 3:
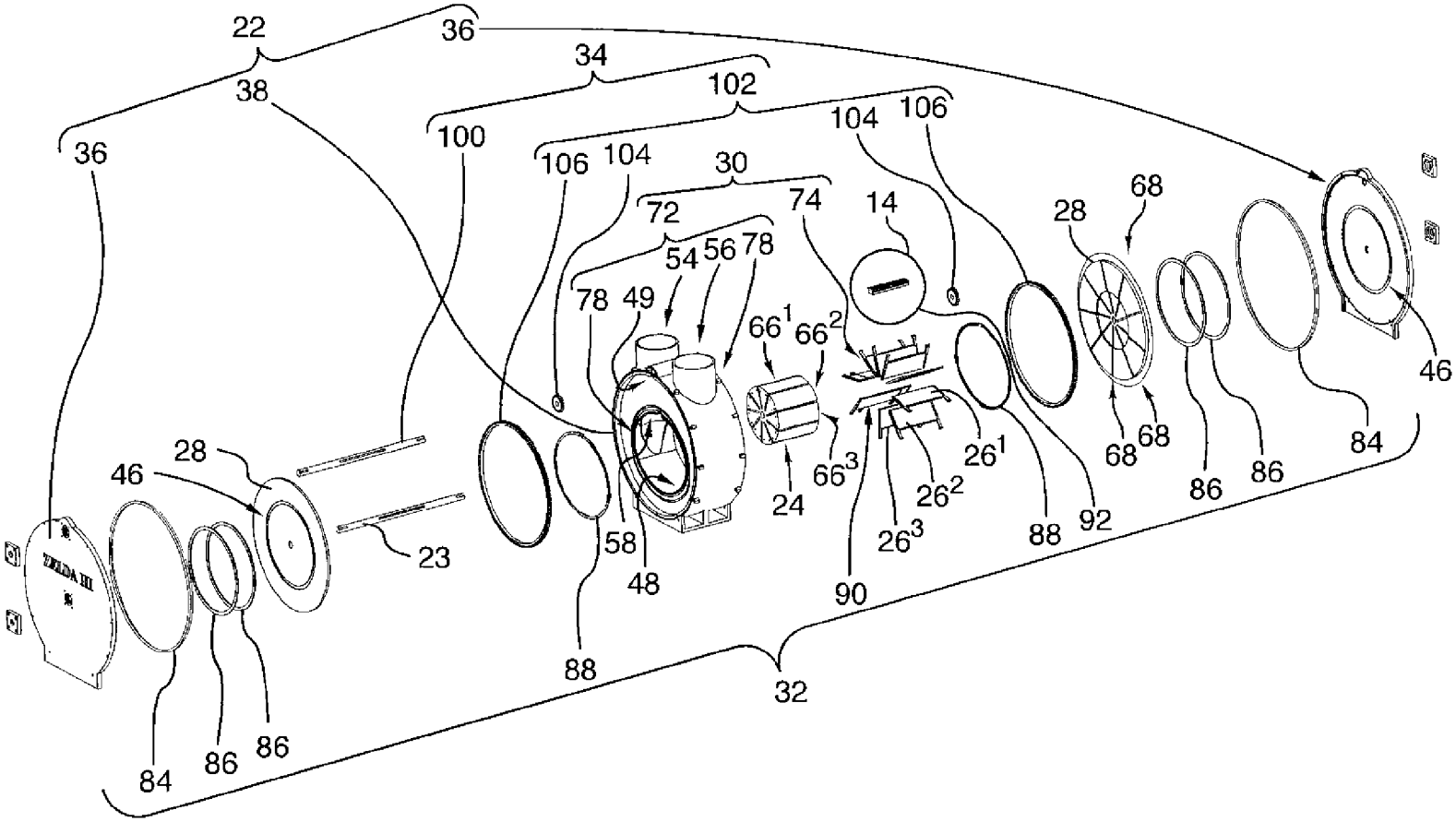
FIG. 3 is a fully exploded view of the structure of FIG. 1.

To provide this functionality, the sealing structure 32 comprises, as indicated in FIG. 3: outer gaskets 84, which seal the end plates 36 to the housing body 38; sealing rings 86 for each of the annular grooves 46, which provide for a dynamic seal between each disc 28 and the adjacent end plate 36; a rigid fitted gasket 88 disposed in each annular channel 52, which provides for a dynamic seal between the housing body 38 and the disc 28; wipers 90 (best seen in FIG. 9A) mounted to the tip of each vane 26; and a bridge seal 92 mounted in the socket 58.

Figure 14A:
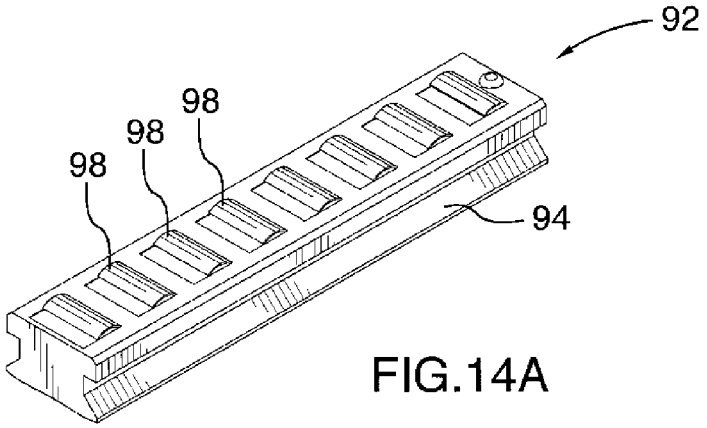
FIG. 14A is an enlarged view of encircled area 14 of FIG. 3.
Figure 14B:
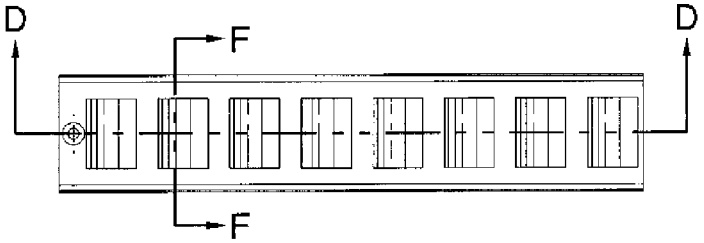
FIG. 14B is a top view of the structure of FIG. 14A.
Figure 14C:
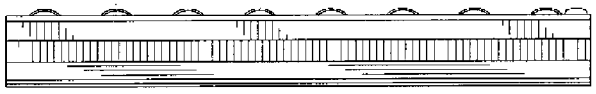
FIG. 14C is a side view of the structure of FIG. 14C.
Figure 14E:
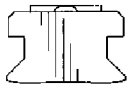
FIG. 14E is an end view of the structure of FIG. 14A.
Figure 14D:
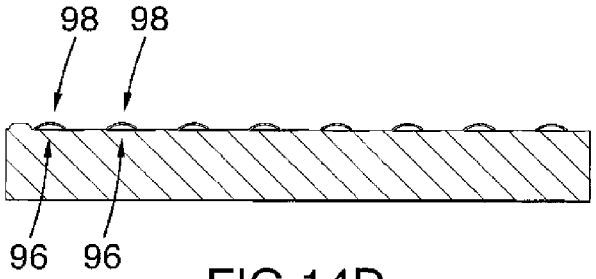
FIG. 14D is a section along D-D of FIG. 14B.
Figure 14F:
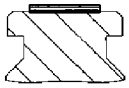
FIG. 14F is a section along F-F of FIG. 14B.
Figure 15B:
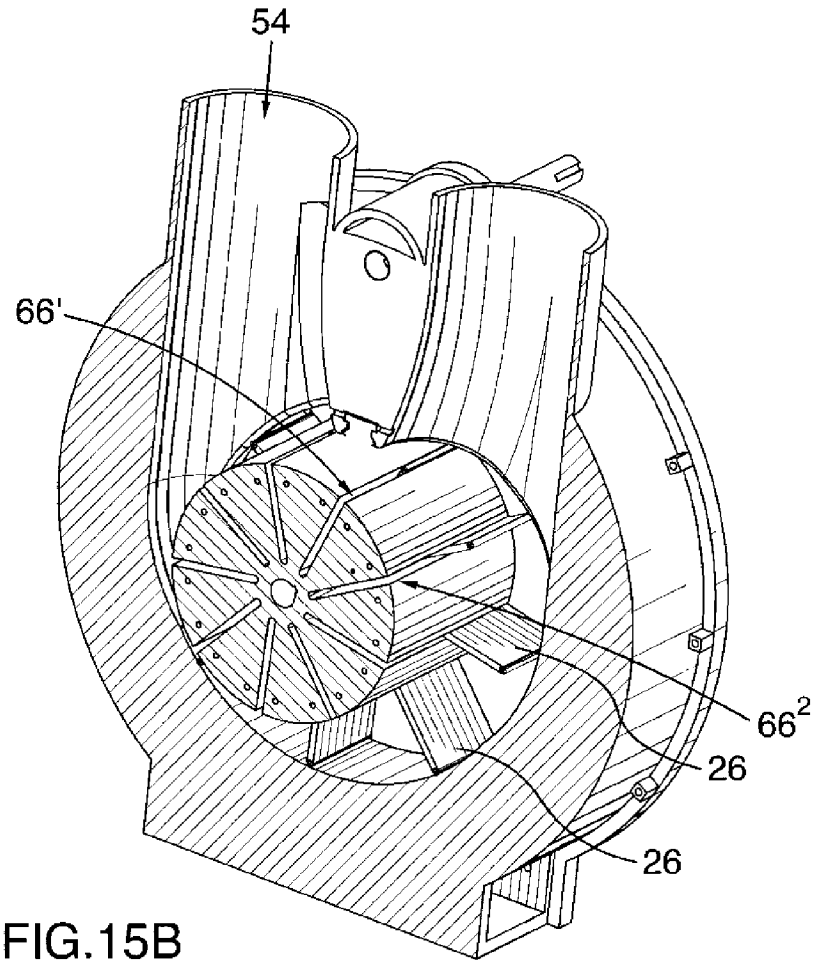
FIG. 15B is a view similar to FIG. 5A.
Figure 15A:
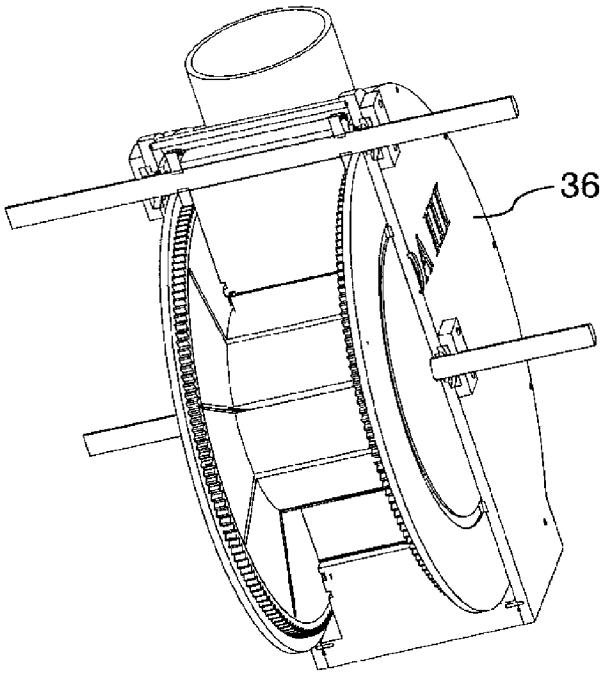
FIG. 15A is a partial cut-away of the structure of FIG. 1.
Figure 16:
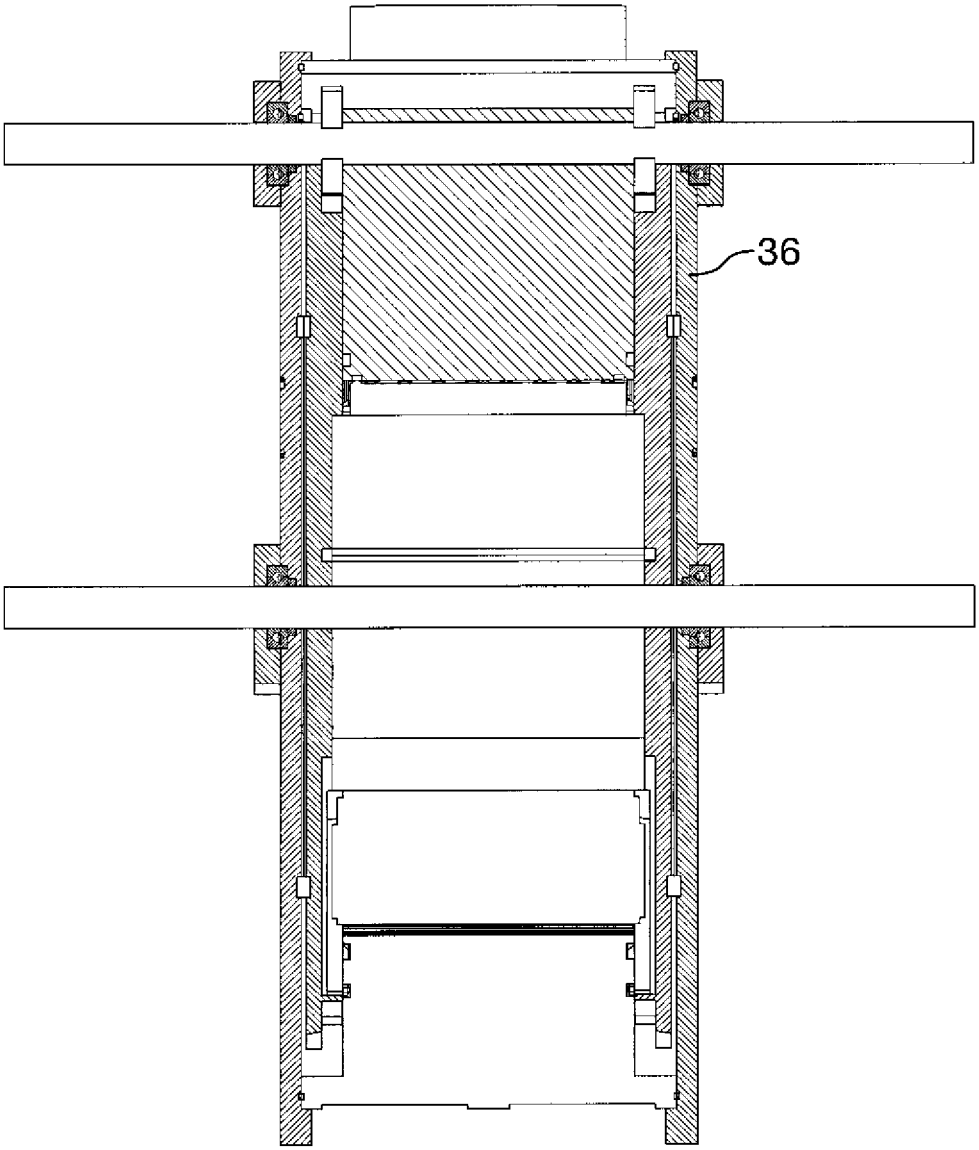
FIG. 16 is a view along 16-16 of FIG. 10.
Figure 17A:
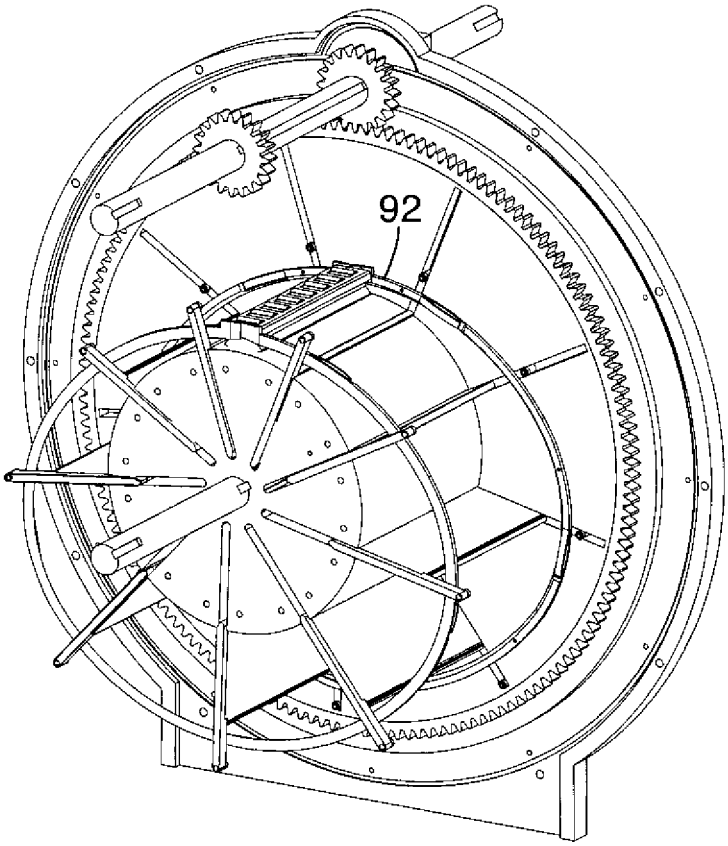
FIG. 17A is a view of the structure of FIG. 1, with portions removed for clarity.
Figure 17B:
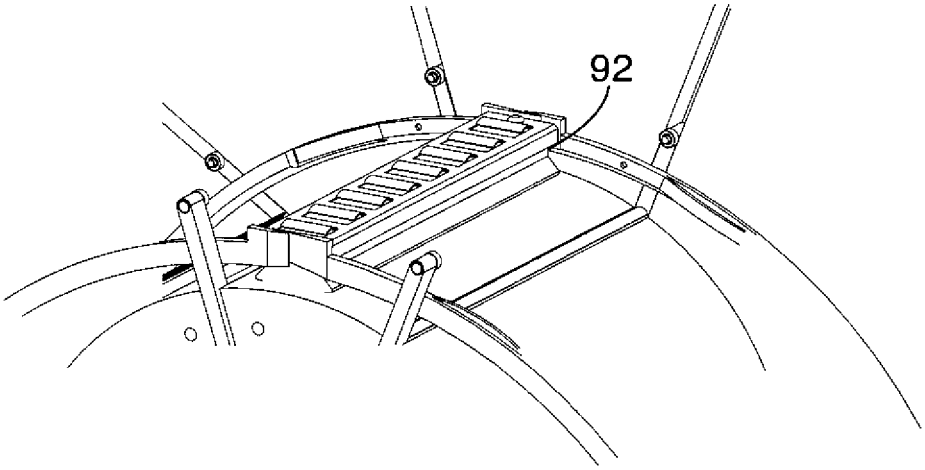
FIG. 17B is an enlarged view of a portion of FIG. 17A.

The bridge seal 92 is shown in isolation in FIG. 14A and will be seen to include: a wiper body 94; a plurality of recesses 96; and, in each recess 96, a spring 98, which collectively urge the wiper body 94 against the rotor body 24 for start-up. In steady-state operation, a bleed passage 110 which leads between the ports 54,56 and the socket 58, allows working pressure to force the bridge seal 92 against the rotor body 24.

Returning again to FIG. 3, the coupler 34 will be seen to comprise a secondary shaft 100 and a gear arrangement 102. The secondary shaft 100, which is keyed at both ends and centrally, passes through the peripheral apertures 42 and the bore 49 and is mounted for rotation to the end plates 36 by bearings 64. The gear arrangement 102 operatively couples the secondary shaft 100 to the rotor body 24 and comprises a pair of first gears 104 keyed to the secondary shaft 100; and for each first gear 104, a second gear 106 carried by a disc 28 and in mesh with said each first gear 104. Persons of ordinary skill will readily appreciate that this provides an alternative mechanism for driving the pump: whereas the pump could be actuated by rotation of the primary shaft 23, this would necessitate, for example, a relatively low speed, high torque motor (not shown); the alternative provided by the secondary shaft 100 and gear arrangement 102 allows the pump to be actuated by rotation of the secondary shaft 100, using, for example, a relatively more commonplace high speed, low torque motor (not shown).

Figure 5A:
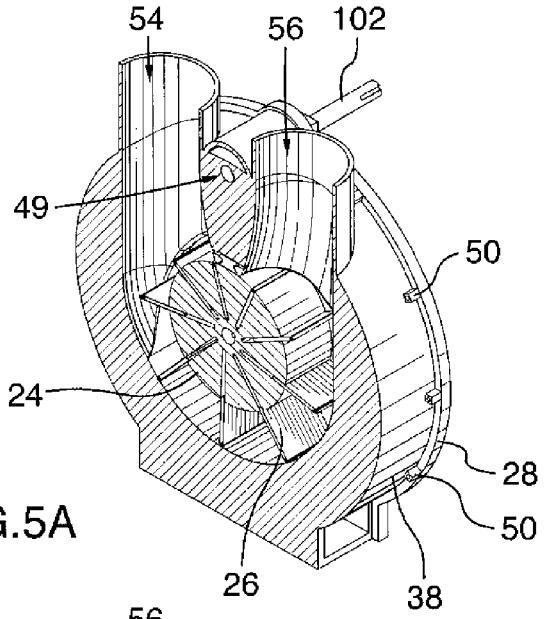
FIG. 5A is a perspective cross-sectional view along 5-5 of FIG. 1.
Figure 5B:
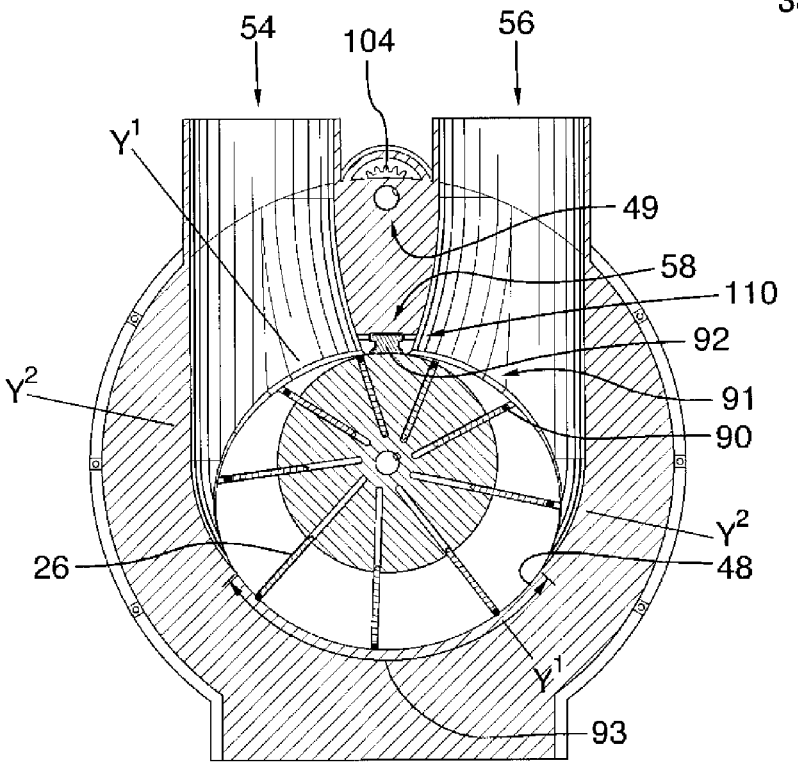
FIG. 5B is a front view of the structure of FIG. 5A.
Figure 6:
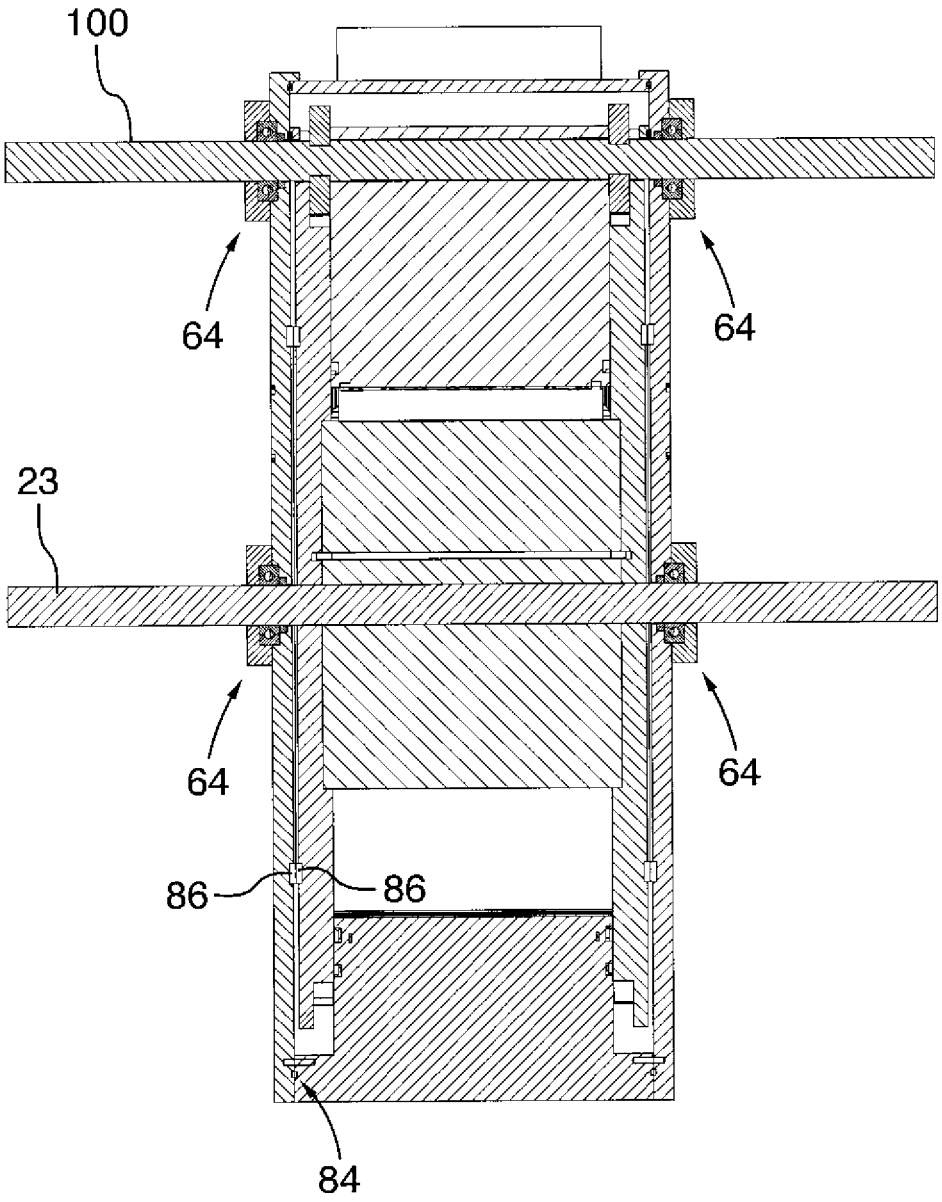
FIG. 6 is a cross-section along 6-6 of FIG. 1.
Figure 7:
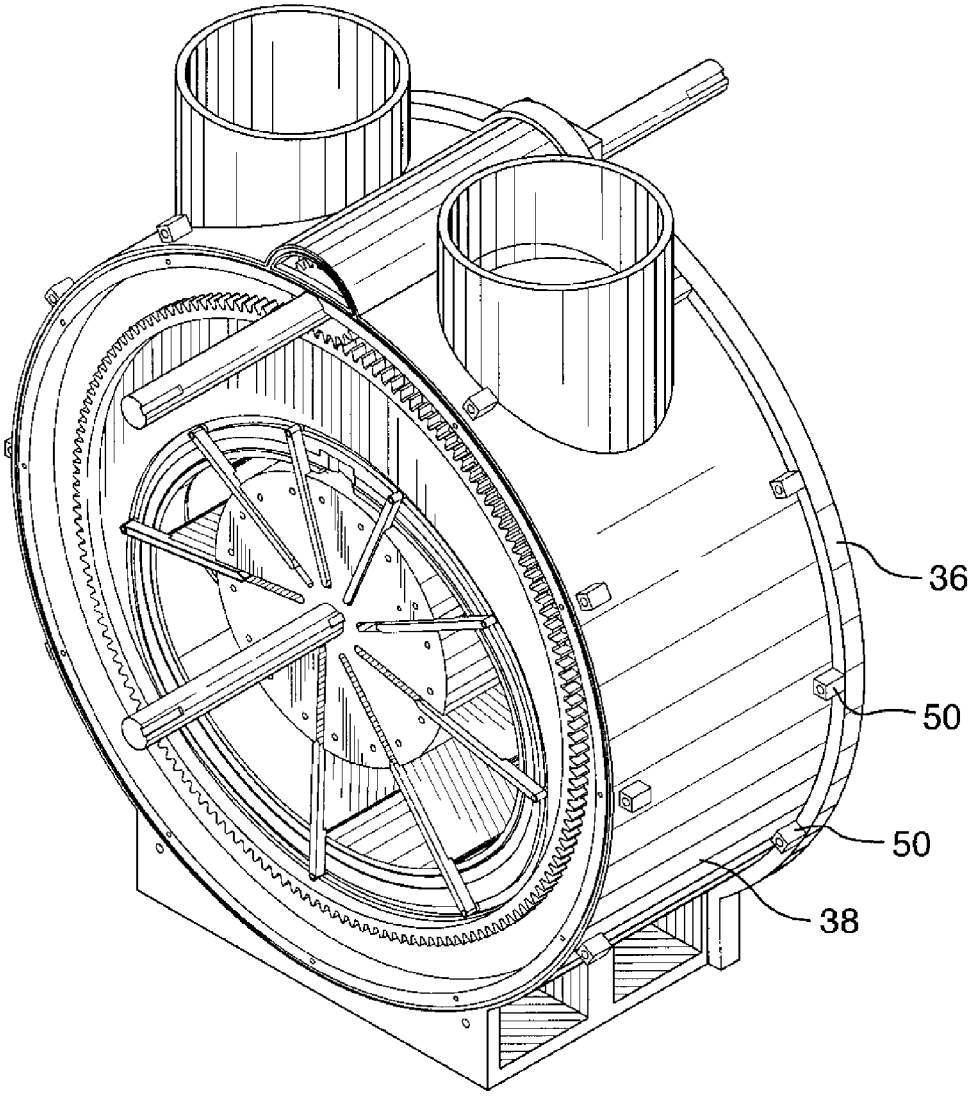
FIG. 7 is an enlarged view of encircled area 7 of FIG. 4.
Figure 8B:
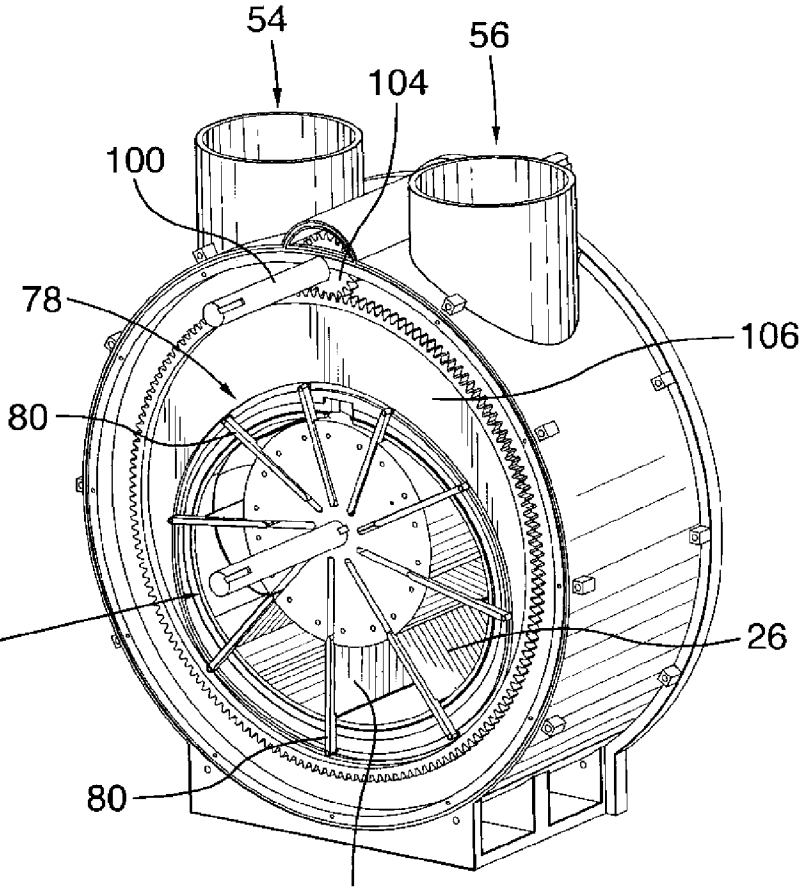
FIG. 8B is a view of the structure of FIG. 7, from another vantage.
Figure 8A:
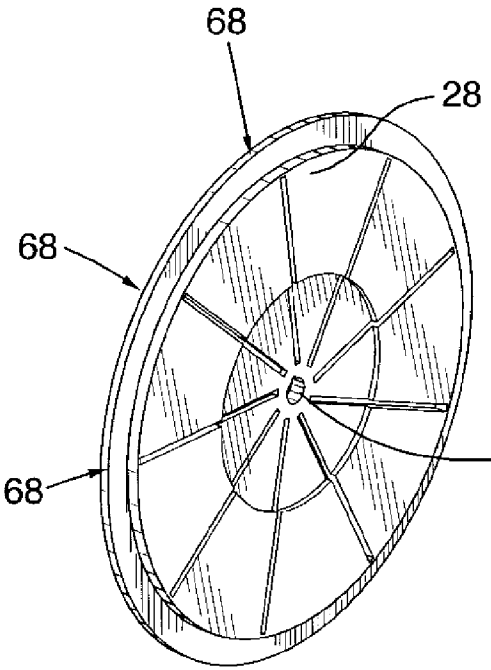
FIG. 8A is an enlarged view of encircled area 8 of FIG. 3.
Figure 9A:
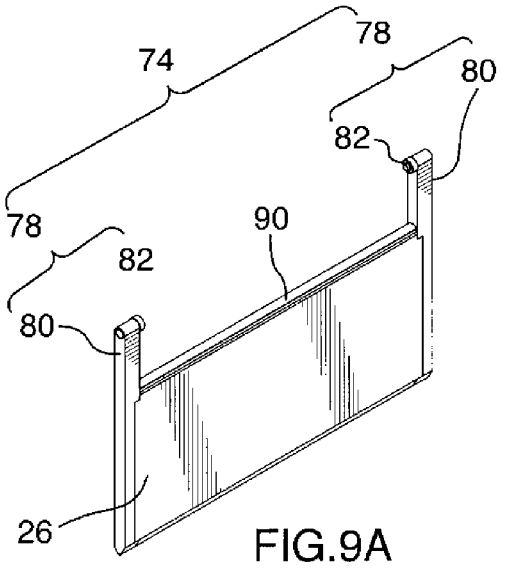
FIG. 9A is an enlarged view of the structure indicated by arrow 9A on FIG. 3.
Figure 9B:
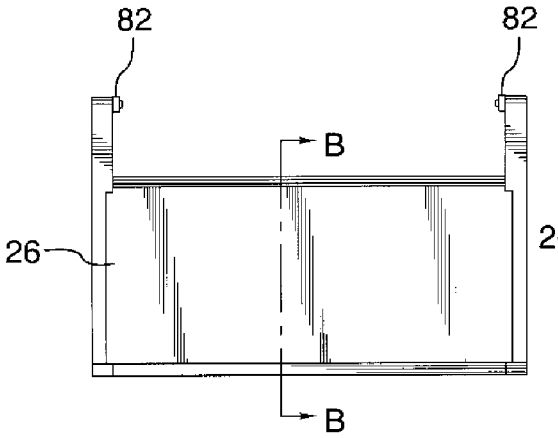
FIG. 9B is a front view of the structure of FIG. 9A.
Figure 9C:
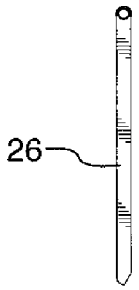
FIG. 9C is a side view of the structure of FIG. 9A.
Figure 9D:
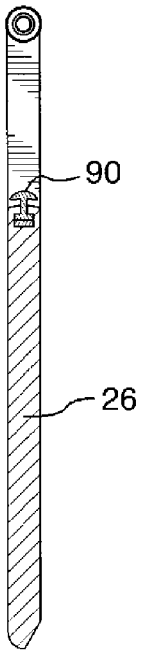
FIG. 9D is a view along B-B of FIG. 9B.
Figure 13:
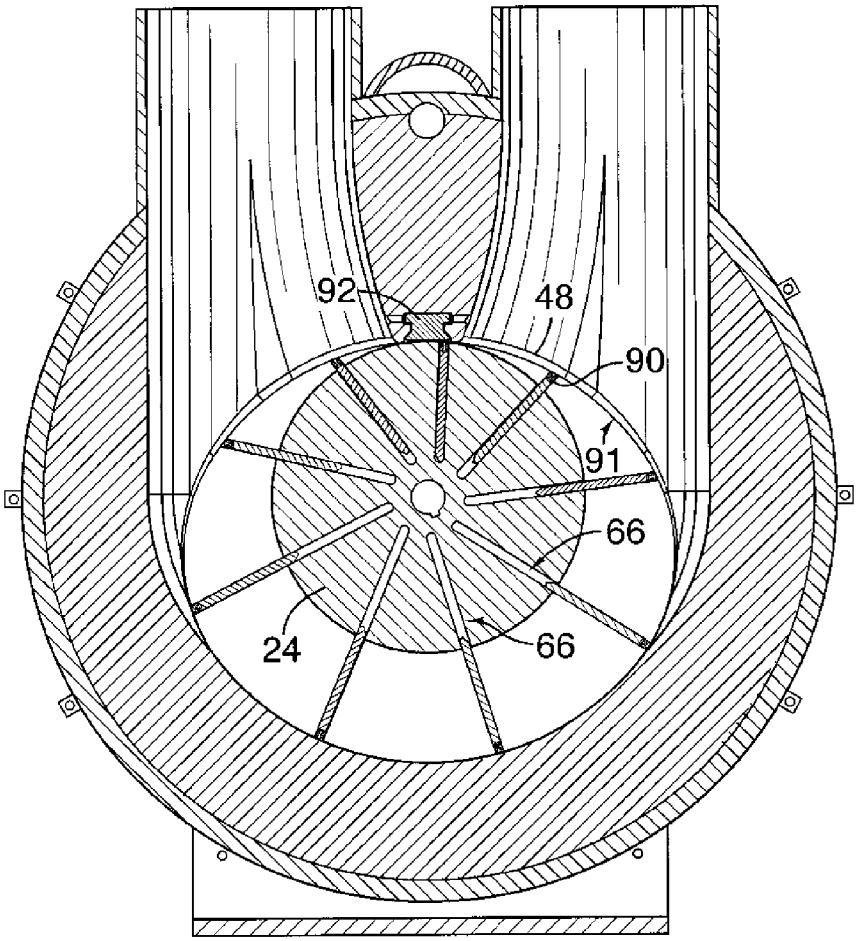
FIG. 13 is a view similar to FIG. 5B.

It will be evident that the above structure has significant advantage:

- by virtue of the shape of the oval track 72, which notably differs from the that of the tubular surface 48, in use:
  - generally-speaking, each vane 26 extends and retracts only when the fluid pressure on the leading and trailing surface of the vane is substantially equal; as a result, the loads borne by the track followers are relatively modest, wear occurs relatively slowly and mechanical efficiency is increased
  - the wipers 90 sweep the tubular surface 48 largely only in the pumping area [indicated by reference numeral 93 in FIG. 5B] and are otherwise spaced apart therefrom; as a result, wear occurs relatively slowly and mechanical efficiency is increased; as well, the retraction of the vanes well in advance of the bridge seal 92, and extension of the vanes well following the bridge seal 92 is, without intending to be bound by theory, believed to have advantage in the context of flow efficiency [less flow disruption]
  - a gap between each wiper 90 and the tubular surface 48 opens relatively quickly after the wiper 90 passes the pumping area 93, disappears relatively shortly before the wiper 90 reaches the pumping area 93, and grows relatively large outside the pumping area, with commensurate impacts on flow dynamics and efficiency. This is best seen in FIGS. 5B and 13, wherein it will be seen that the wipers 90 are spaced from the tubular surface 48 near the bridge seal 92, leaving a gap 91
  - the volume of the pumping chambers (the spaces defined between the rotor and the tubular surface, between adjacent pairs of vanes disposed in the pumping area 93) does not change, which allows for tight sealage and also facilitates sharing of loads amongst vanes
  - sudden drastic changes in vane position and vane motion are avoided, with advantageous impacts on wear
- by virtue of the orientation of the translation axes $Y_1$-$Y^1$, $Y^2$-$Y^2$, etc. of the vanes, i.e. offset from the rotation axis X-X, in use, when the fluid pressure on the leading and trailing surface of the vane is otherwise than substantially equal (i.e. when the vane is extended and under load), said each vane is orientated substantially perpendicular to the direction of fluid flow. This distributes the load from the vanes to the side disks and rotor body, thereby reducing loads in the vanes, simplifying production and avoiding turbulence in use
- the rigid fitted gasket 88 stops leakage and also allows the housing to have a relief or cut for removing or loading vanes for assembly or repairs.

Figure 18A:
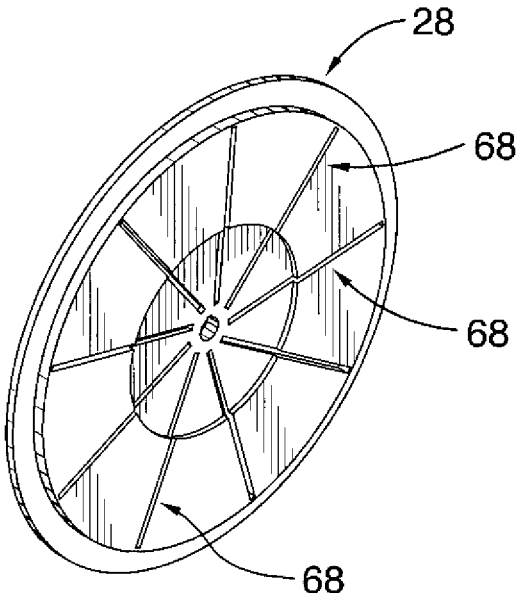
FIG. 18A is a view similar to FIG. 8A.
Figure 18B:
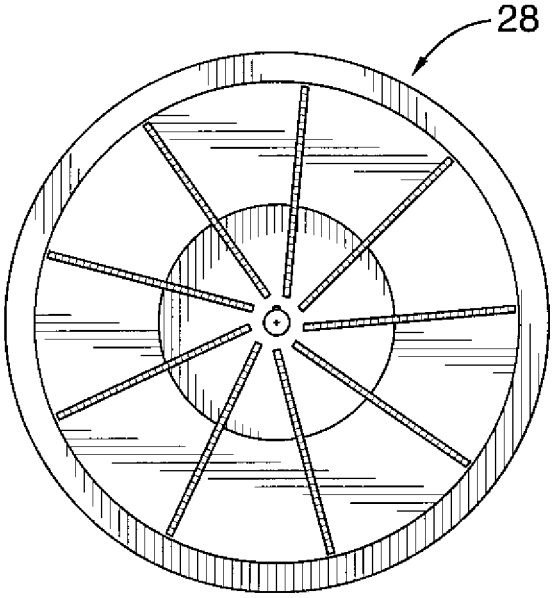
FIG. 18B is a front view of the structure of FIG. 18A.
Figure 18C:
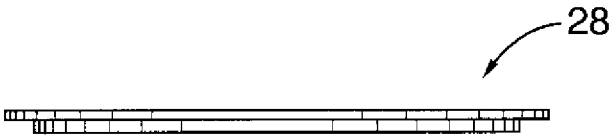
FIG. 18C is a side view of the structure of FIG. 18A.
Figure 19:
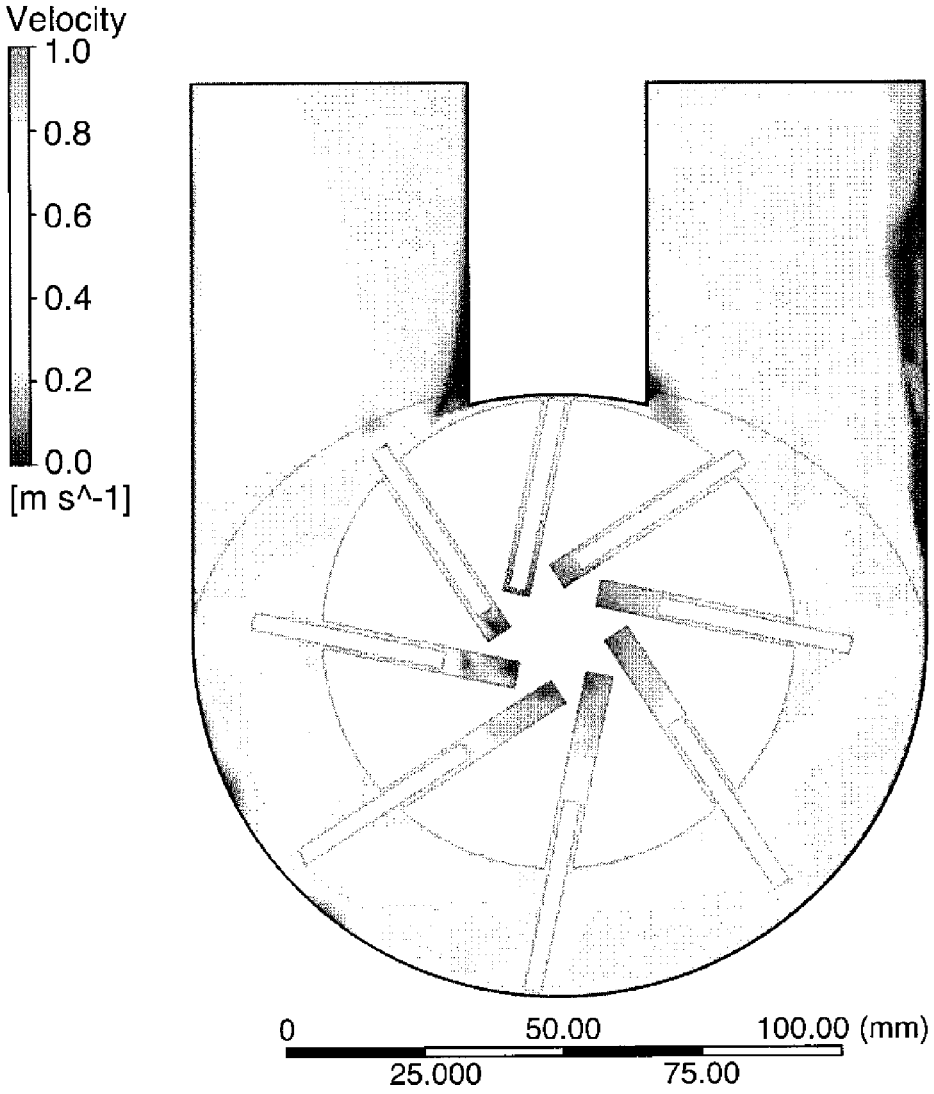
FIG. 19 is a fluid velocity plot.
Figure 20:
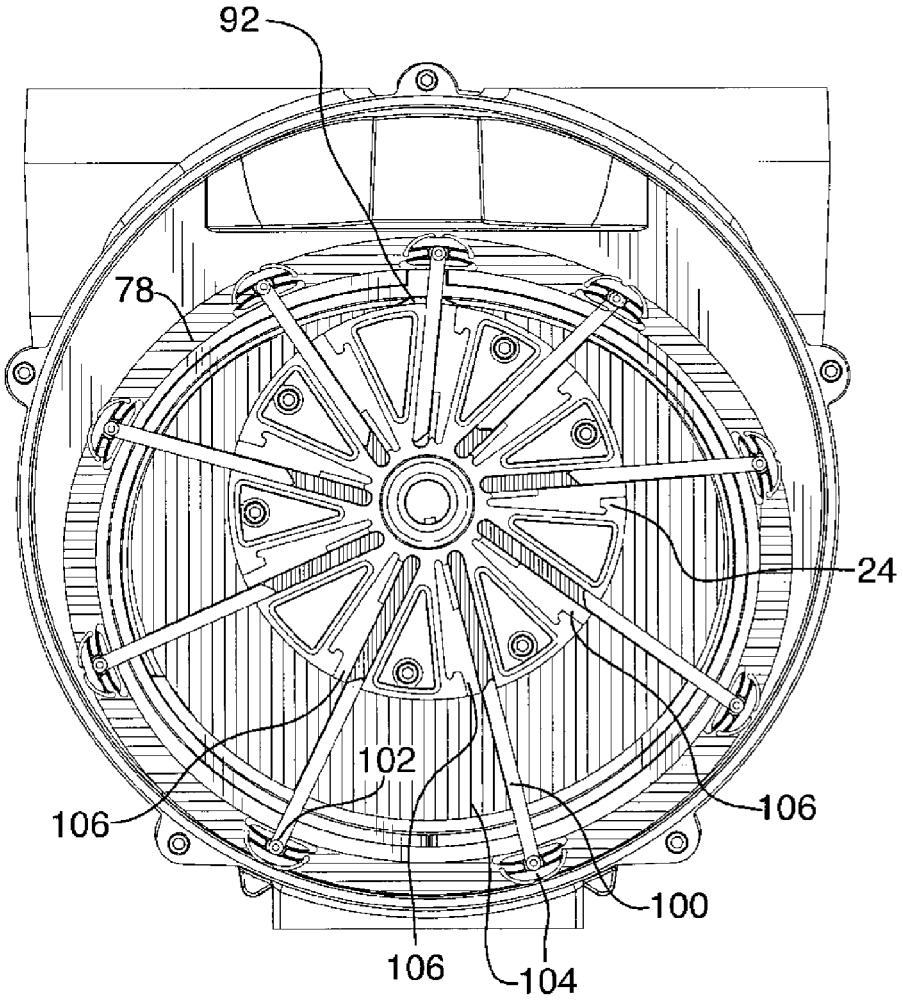
FIG. 20 is a view similar to FIG. 10 of another embodiment of the invention.
Figure 21:
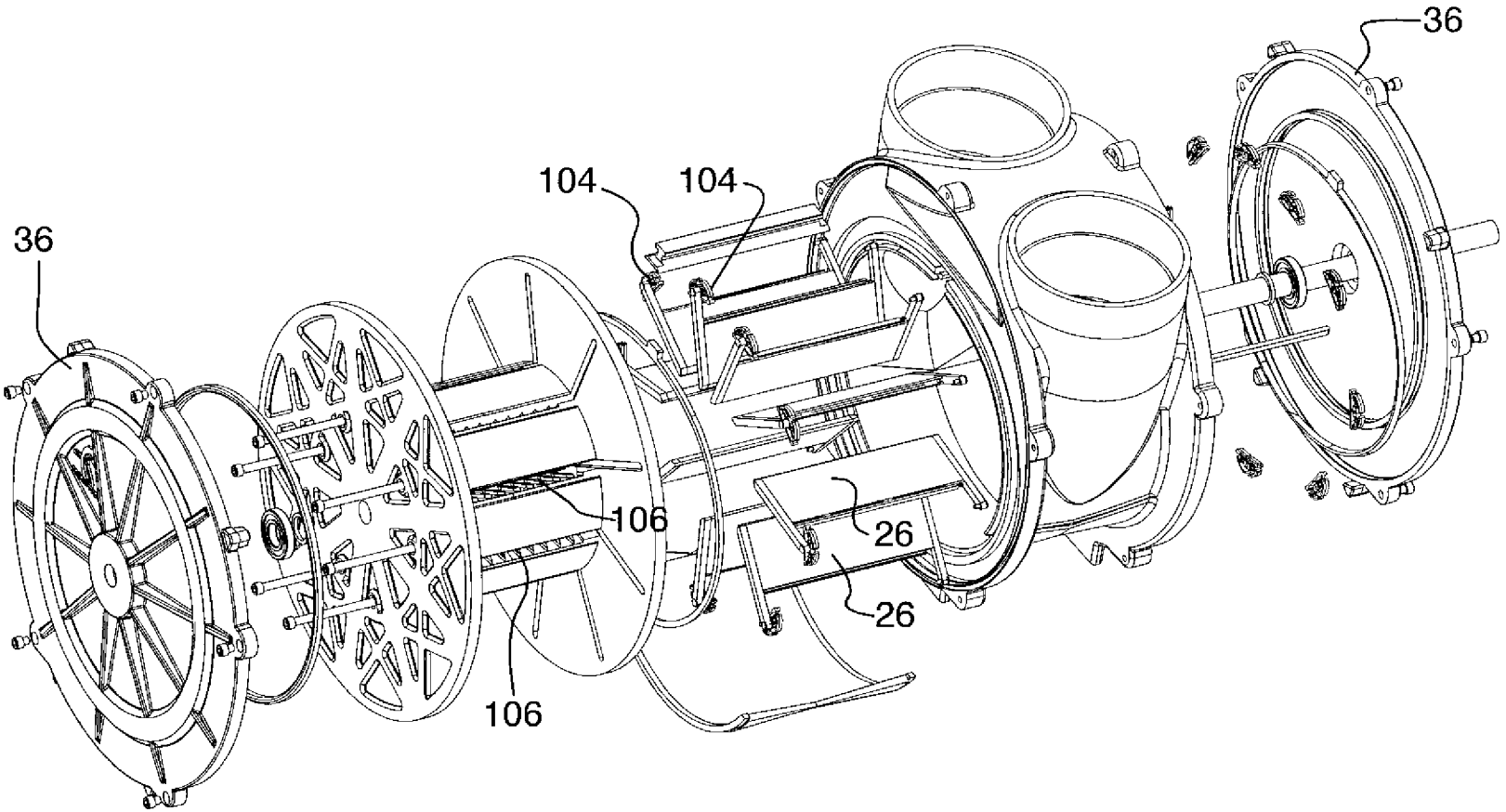
FIG. 21 is an exploded view of the embodiment of FIG. 20.

FIG. 19 is a CFD model based on a device similar in operation to the device of FIGS. 1-18C. [One notable difference being the existence of only eight (8) vanes, which was done for computational simplicity and is not believed to have any material effect on the result. For the purpose of the model, the vane geometry was simplified, and leakage flow at the vane tip was assumed; these divergences would undoubtedly impact the CFD results, but it is believed that these changes would not significantly impact upon the results.] Herein, it will be seen that the flow uniformity throughout the pumping region and at the inlet and outfall is reasonably good, and that velocity drops off significantly in the region near the bridge, that is, point of maximum vane retraction; persons of ordinary skill will appreciate that the foregoing suggests that turbulence is not a major concern, which has advantageous impacts upon efficiency.

In this regard, testing was done on a pump of the above-noted type, sized for movement of 1.3 gallons of water per rotation. The pump has shown the following characteristics:

- capable of self-priming water to 26'-6" at 100 rpm, at 1000 feet above sea level
- pumped 1.6 million gallons of water without failure
- when running at 0.644 HP, pumping 151.29 gpm of water, the pump achieved volumetric efficiency of 94.59% and mechanical efficiency of 83.33%

Whereas but a single embodiment is hereinbefore described, it will be evident that variations are possible.

For example, whereas a secondary shaft and coupler are illustrated in the structure of FIGS. 1-18C, these could be routinely omitted.

Further, whereas the device in FIGS. 1-18C is indicated to be a pump, it will be evident that the structure could be utilized with other rotary devices, such as motors, meters and propulsion devices.

Additionally, whereas specific designs are illustrated for the bridge seal, wipers, etc., it will be evident that sealing could be obtained through other mechanisms.

As well, whereas rollers are shown in FIGS. 1-18C, the followers could take other forms, for example, simple studs adapted for sliding movement in the track.

Indeed, another form of the followers is shown in FIGS. 20-23C.

These drawings show a rotary device similar to that shown in FIGS. 1-18C but differing notably therefrom in that:

- the track follower for each vane is defined by a bearing assembly for each raceway 78, each bearing assembly including (i) an arm 100 extending from said each vane and terminating in a pintle 102 and (ii) a bearing shoe 104 mounted to traverse said raceway 78 and in which the pintle 102 is mounted for rotation; and vent plates 106 are provided for each vane.

Figure 22A:
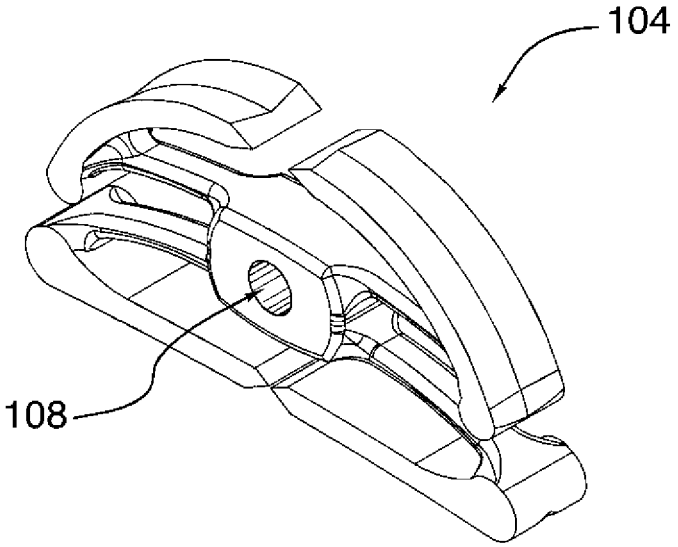
FIG. 22A is a perspective view of a portion of the structure of FIG. 20.
Figure 22B:
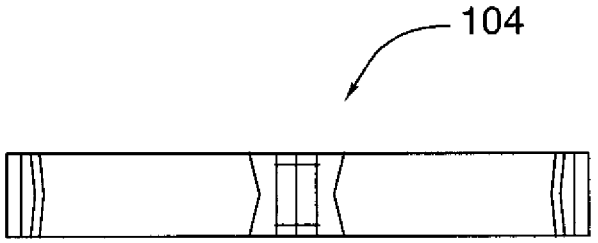
FIG. 22B is a top view of the structure of FIG. 22A.
Figure 22C:
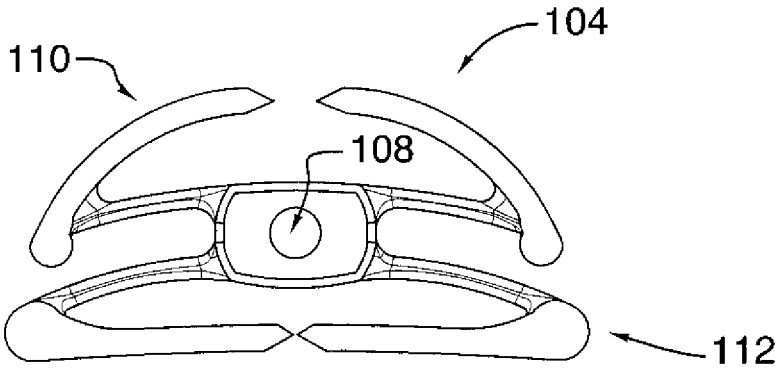
FIG. 22C is a front view of the structure of FIG. 22A.

The bearing shoe 104 will be seen in FIGS. 22A-22C to be an injection-molded, resilient, hard-wearing plastic device having a central socket 108 in which pintle 102 is mounted in use and having upper 110 and lower 112 runners.

The upper 110 and lower 112 runners are each formed generally in the manner of a leaf spring to allow for limited radial motion of the vane and allow the raceway 78 to be shaped so as to bring the wipers 90 against the tubular surface 48 with some force in the pumping area, i.e. the raceways and bearing shoes are shaped and adapted such that, but for the spring action of the bearing shoes, the wipers would be in interference contact with the tubular surface. The spring action ensures good sealage and also allows for thermal expansion and contraction of the vanes in use, which, if not otherwise accommodated, could result in wear or leakage depending upon the ambient conditions and the coefficient of thermal expansion of the vanes.

The vent plates 106 are mounted one for each vane and so as to define one of the surfaces of the slot for each vane and against which said vane slides in use. The surface against which said each vane slides is defined by a plurality of raised ridges 112, each having tapered ends 114, so as to define channels 116 in which fluid can travel, as best seen in FIG. 23 C The vent plates 106 avoid hydraulic lock on vane extension and retraction which could otherwise occur in some situations. Vent plates 106 will be seen in FIG. 20 to each terminate at its radial limit in an arcuate extension of the rotor body, so as to provide for a smooth transition as the vent plates pass the bridge seal 92.

Figure 24:
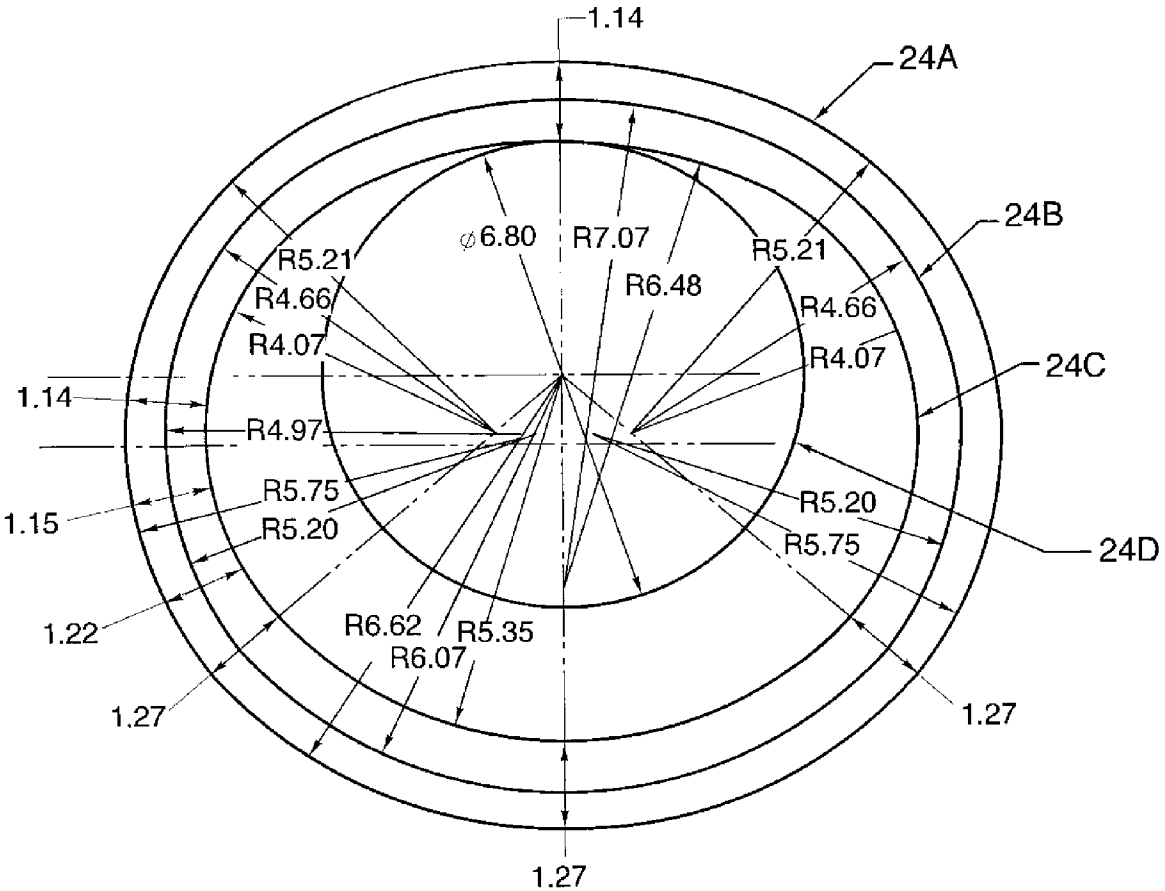
FIG. 24 is a diagram showing geometric relationships amongst the components of a rotary device according to an exemplary embodiment.

Additionally, whereas a specific geometry is shown in FIGS. 5B and 13, variation is also possible herein. In this regard, reference is made to FIG. 24, which shows the geometry of a rotary device according to an exemplary embodiment of the invention. In FIG. 24, the outside edge of the path of the bearing shoes is indicated by arc 24A; the inside edge of the path of the bearing shoes is indicated by arc 24B; the limit of the tubular surface is indicated by 24C; and the outer circumference of the rotor body is indicated by 24D. The drawing shows various radii and geometric relationships for arcs 24A-24D, which will be readily understood by persons of ordinary skill and accordingly further description is neither required nor provided.

Figure 25:
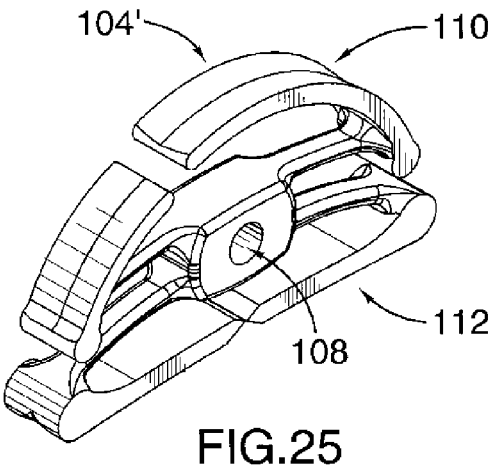
FIG. 25 is a view similar to and showing an alternate embodiment of the structure of FIG. 22.
Figure 25E:
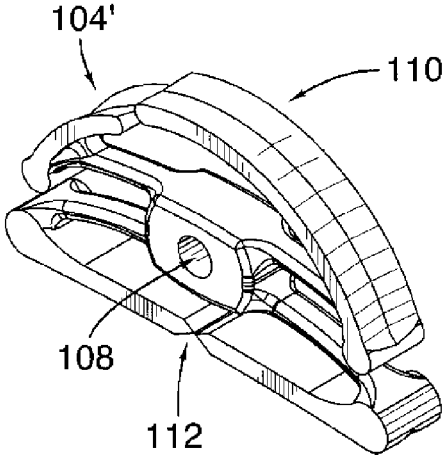
FIG. 25E is another perspective view of the structure of FIG. 25.
Figure 25A:
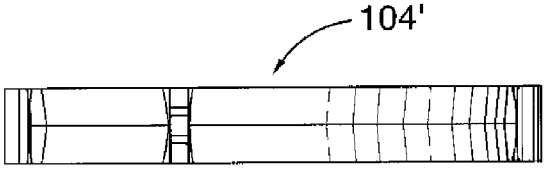
FIG. 25A is a top view of the structure of FIG. 25.
Figure 25B:
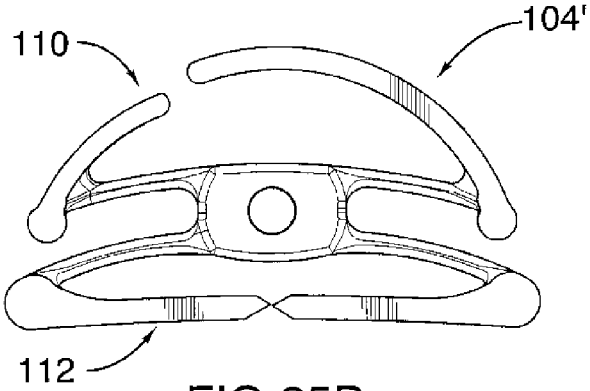
FIG. 25B is a front view of the structure of FIG. 25.
Figure 25D:
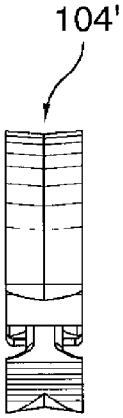
FIG. 25D is an end view of the structure of FIG. 25.
Figure 25C:
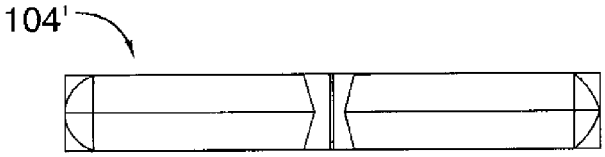
FIG. 25C is a bottom view of the structure of FIG. 25.
Figure 26:
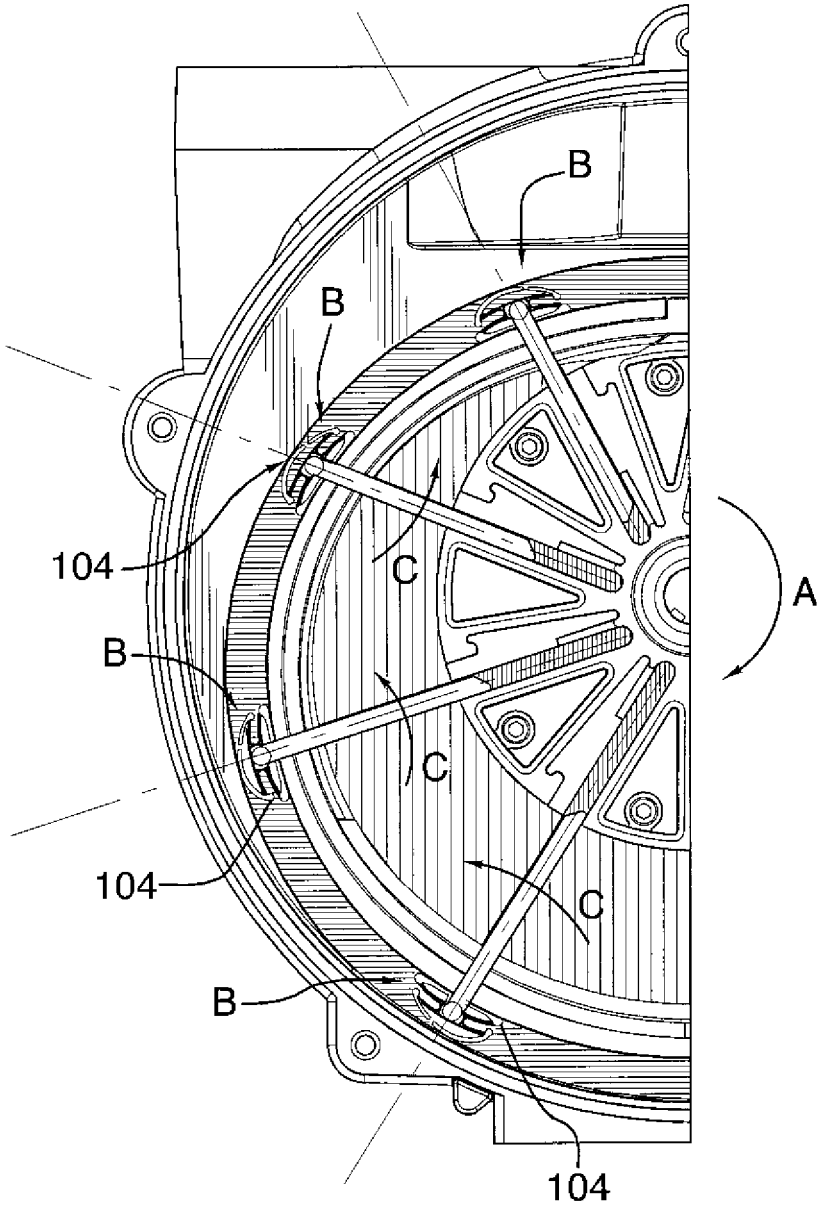
FIG. 26 is an enlarged partial view of the structure of FIG. 20.
Figure 27:
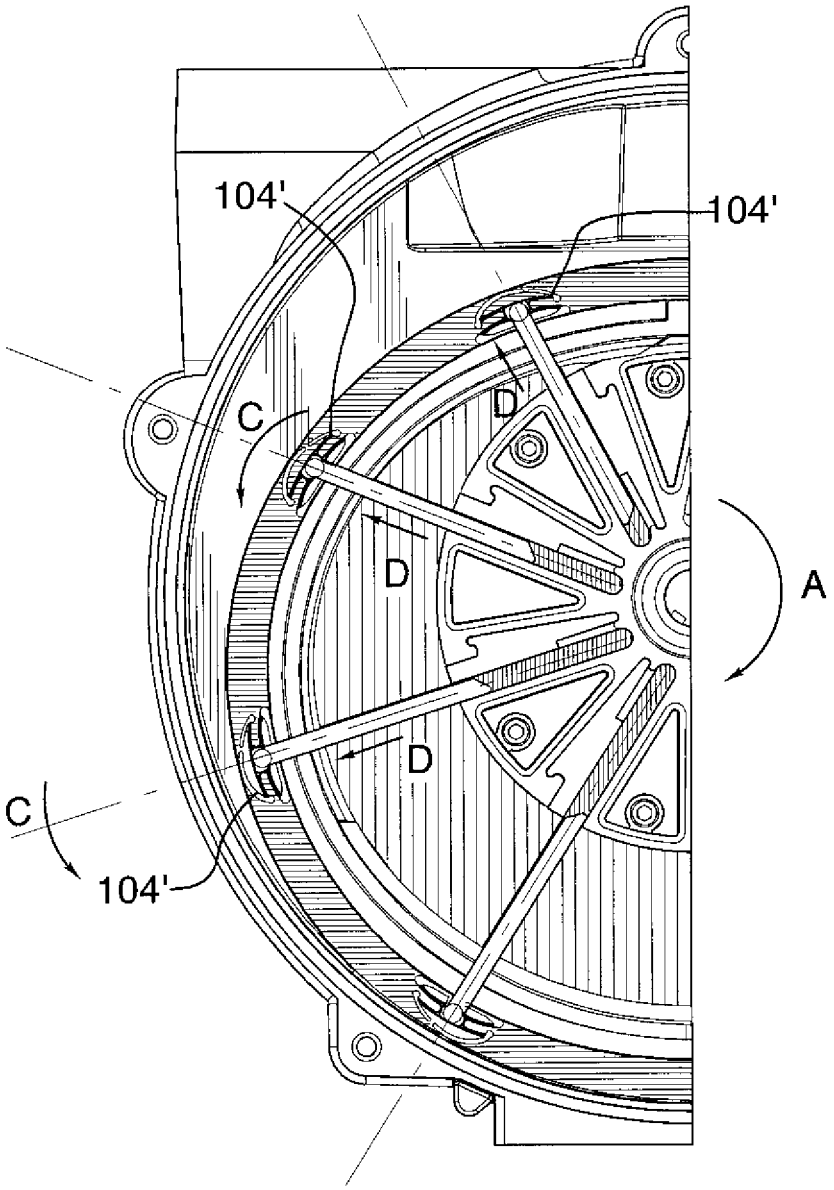
FIG. 27 is a view similar to FIG. 26 showing the structure of FIG. 25 in use.

Yet another variation is shown in FIG. 25. Herein, a variation 104' of the bearing shoe 104 of FIG. 22 is shown. Bearing shoe 104' looks and functions similarly to bearing shoe 104 and thus is labeled accordingly. However, it is speculated that bearing shoe 104' may show improved performance in use. By way of background, reference is made to FIG. 26, which shows a portion of the device of FIG. 20 that includes bearing shoes 104. Arrow A shows the direction of rotation of the rotor. In this rotary device, localized wear has been noticed at the locations indicated by arrows B. Without intending to be bound by theory, this localized wear is believed to be caused, inter alia, by frictional forces that tend to cause bearing shoes 104 to rotate in the direction of arrows C. FIG. 27 shows the structure of FIG. 26, with bearing shoes 104' substituted for bearing shoes 104. Bearing shoes 104' are pre-stressed once positioned in the raceways so as to be relatively more resistant to compression on the trailing side that bearing shoes 104, which is believed will create forces as indicated by arrows D which will counter the rotational forces and minimize localized bearing wear as well as binding.

Figure 28:
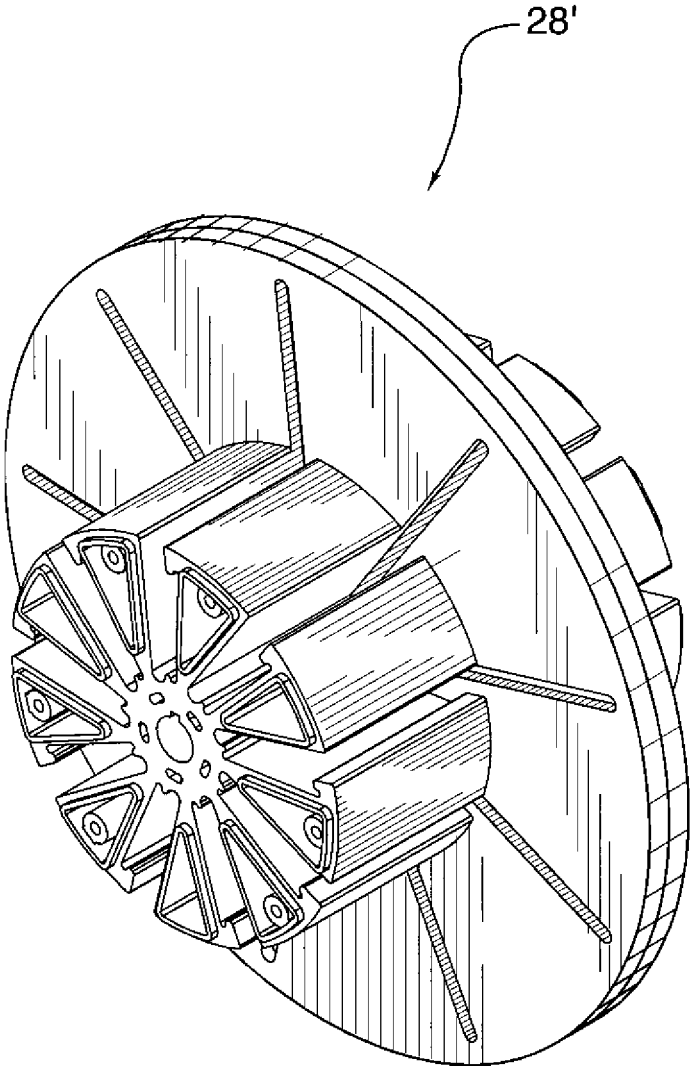
FIG. 28 is a view similar to FIG. 18A showing an alternate embodiment of the structure of FIG. 18A.
Figure 29:
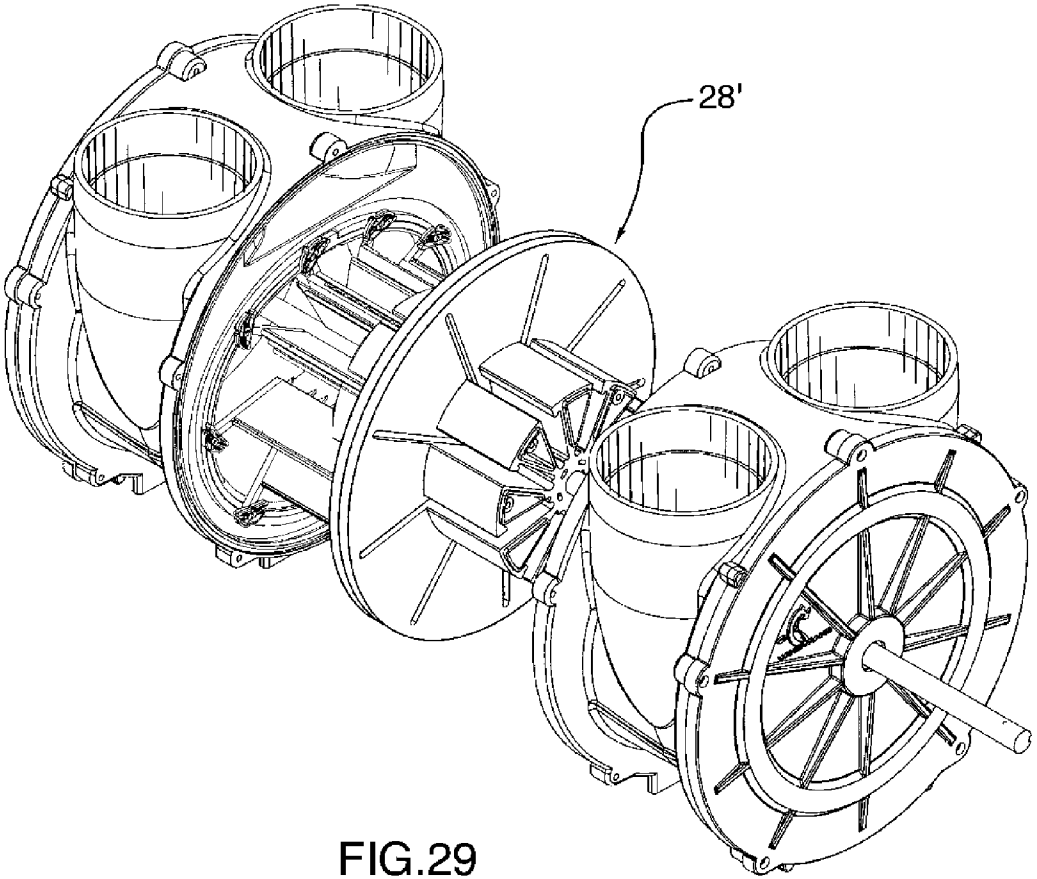
FIG. 29 is a perspective view showing the structure of FIG. 28 in use.

Yet another variation is shown in FIG. 28, which shows a structure similar to plate 28 of FIG. 18A but having slots defined on both faces therein. Use of plate 28' allows a pair of rotary devices to be ganged upon a common shaft, as shown in FIG. 29, with advantageous impacts in terms of flexibility and manufacturing costs.

In view of the foregoing, the invention should be understood as limited only by the claims appended hereto, purposively construed.

The invention claimed is:

1. A method of operating a rotary device, the method comprising:

pumping a fluid in the rotary device, the rotary device having a tubular surface defining in part a tubular volume, the tubular volume defining at least in part a pumping zone and a first working zone;

rotating a rotor, the rotor mounted for rotation about a rotation axis, the rotor having a body mounted within the tubular volume and having slots, each slot extending at least generally radially from the axis, each slot housing at least a portion of a vane having a wiper disposed on an end of the vane, each vane including a respectively associated track follower connected to the vane, each track follower sized to engage and traverse an oval track, the oval track defined in the rotary device and having a shape different than a cross-section of the tubular volume;

extracting, at a first extraction distance, the vane at the first working zone of the tubular surface, the first extraction distance being greater than zero separating the wiper from the tubular surface, the first extraction distance being a variable distance decreasing as the vane approaches the pumping zone;

extracting, at a second extraction distance, the vane at the pumping zone of the tubular surface, the second extraction distance being the distance separating the wiper from the tubular surface, the second extraction distance being less than the first extraction distance; and pumping the fluid out of the rotary device;

wherein the first extraction distance gradually changes until it reaches a minimum first extraction distance, the minimum first extraction distance being equal to the second extraction distance.

2. The method of claim 1, wherein the second extraction distance is substantially equal to zero.

3. The method of claim 1, wherein during extracting, at the first working zone, the wiper is separated from the tubular surface by a variable distance, the variable distance decreasing as the vane approaches the pumping zone.

4. The method of claim 1, further comprising retracting, at a first retraction distance, the vane at a second working zone adjacent the pumping zone, the first retraction distance being the distance separating the wiper from the tubular surface.

5. The method of claim 1, further comprising sealing the fluid to flow into and out of the rotary device substantially only through an input port and an output port.

6. A method of operating a rotary device, the method comprising:

pumping a fluid in the rotary device, the rotary device comprising a housing having a tubular surface defining in part a tubular volume, the tubular volume defining at least in part a pumping zone and a first working zone;

rotating a rotor, the rotor mounted for rotation about a rotation axis, the rotor having a body mounted within the tubular volume and having slots, each slot extending at least generally radially from the axis, each slot housing at least a portion of a vane having a wiper disposed on an end of the vane, each vane including a respectively associated track follower connected to the vane, each track follower sized to engage and traverse an oval track, the oval track defined in the housing outside the tubular volume and having a shape different than a cross-section of the tubular volume;

extracting, at a first extraction distance, the vane at the first working zone of the tubular surface, the first extraction distance being greater than zero separating the wiper from the tubular surface, the first extraction distance being a variable distance decreasing as the vane approaches the pumping zone;

extracting, at a second extraction distance, the vane at the pumping zone of the tubular surface, the second extraction distance being the distance separating the wiper from the tubular surface, the second extraction distance being less than the first extraction distance; and pumping the fluid out of the rotary device;

wherein the first extraction distance gradually changes until it reaches a minimum first extraction distance, the minimum first extraction distance being equal to the second extraction distance.

7. The method of claim 6, wherein the second extraction distance is substantially equal to zero.

8. The method of claim 6, wherein during extracting, at the first working zone, the wiper is separated from the tubular surface by a variable distance, the variable distance decreasing as the vane approaches the pumping zone.

9. The method of claim 6, further comprising retracting, at a first retraction distance, the vane at a second working zone adjacent the pumping zone, the first retraction distance being the distance separating the wiper from the tubular surface.

10. The method of claim 6, further comprising sealing the fluid to flow into and out of the rotary device substantially only through an input port and an output port.

* * * * *